US009223283B2

(12) United States Patent
Ito et al.

(10) Patent No.: US 9,223,283 B2
(45) Date of Patent: Dec. 29, 2015

(54) IMAGE FORMING APPARATUS AND LUBRICANT APPLICATION METHOD

(71) Applicant: Konica Minolta, Inc., Chiyoda-ku (JP)

(72) Inventors: Yohei Ito, Toyokawa (JP); Tsugihito Yoshiyama, Toyohashi (JP); Yoshiki Nakane, Toyokawa (JP); Tomohisa Yoshida, Toyokawa (JP); Masanori Kawada, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/335,226

(22) Filed: Jul. 18, 2014

(65) Prior Publication Data

US 2015/0030364 A1 Jan. 29, 2015

(30) Foreign Application Priority Data

Jul. 23, 2013 (JP) ..... 2013-152714

(51) Int. Cl.
*G03G 21/00* (2006.01)

(52) U.S. Cl.
CPC .... *G03G 21/0094* (2013.01); *G03G 2215/0135* (2013.01)

(58) Field of Classification Search
CPC ..... G03G 21/0094; G03G 21/0011; G03G 21/00; G03G 15/161; G03G 21/0005
USPC ..... 399/346
See application file for complete search history.

(56) References Cited

U.S. PATENT DOCUMENTS

| | | | | |
|---|---|---|---|---|
| 2005/0047804 | A1 | 3/2005 | Kosuge | |
| 2006/0210334 | A1* | 9/2006 | Tokumasu et al. | 399/346 |
| 2010/0003052 | A1* | 1/2010 | Nakamatsu et al. | 399/123 |
| 2011/0217101 | A1* | 9/2011 | Okamoto et al. | 399/346 |

FOREIGN PATENT DOCUMENTS

| | | | |
|---|---|---|---|
| JP | 2005-99649 | A | 4/2005 |
| JP | 2008-089771 | A | 4/2008 |
| JP | 2011-150058 | A | 8/2011 |

OTHER PUBLICATIONS

Machine translation of JP 2008-089771 A, publication date: Apr. 17, 2008.*

(Continued)

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

An image forming apparatus for forming an image on a rotative image carrier and transferring the image onto an object, including: a cleaning unit removing a residual material from the image carrier; and a lubricant applying unit applying lubricant to a circumferential surface of the image carrier, the lubricant applying unit including: a rotative transporter picking up and retaining lubricant, transporting the lubricant to a lubricant application point, and supplying a portion of the lubricant to the image carrier at the lubricant application point; an ejector causing the transporter to eject a portion of the lubricant retained by the transporter; a collector collecting the portion of the lubricant ejected from the transporter; and a controller controlling ejection of the portion of the lubricant so as to maintain the amount of the lubricant retained by the transporter as no greater than a predetermined upper limit.

18 Claims, 15 Drawing Sheets

Supply amount $\gamma$ = Consumption amount $\alpha$ − Accumulation amount $\beta$

(56) References Cited

OTHER PUBLICATIONS

Machine translation of JP 2013-101273 A, publication date: May 23, 2013.*

Notification of Reasons for Refusal issued Jul. 7, 2015 by Japanese Patent Office in corresponding Japanese Patent Application No. 2013-152714, and an English translation thereof.

* cited by examiner

Supply amount $\gamma$ = Consumption amount $\alpha$ - Accumulation amount $\beta$

FIG. 12

| | Lubricant supply amount (g/k sheets) | Brush pressure | ΔV (V) during image formation period | Non-image formation period | | | | | Evaluation results | | | | |
|---|---|---|---|---|---|---|---|---|---|---|---|---|---|
| | | | | Lubricant ejection control | | | | | Retained -lubricant amount (mg) | Mixed amount (wt%) | Fogging | Performance in cleaning | Friction coefficient |
| | | | | ΔV (V) | Vo (V) | Vbr (V) | R | Micro vibration | | | | | |
| Practical Example 1 | 42 | Standard | -300 | 100 | -100 | -400 | 0.7 | Not applied | 550 | 0.41 | ○ | ○ | 0.2 |
| 2 | 42 | Standard | -300 | 600 | -100 | -700 | 1.3 | Not applied | 311 | 0.38 | ○ | ○ | 0.18 |
| 3 | 58 | Standard | -100 | 600 | -100 | -700 | 1.3 | Not applied | 210 | 0.44 | △ | ○ | 0.18 |
| 4 | 42 | Standard | -300 | 300 | -100 | -400 | 1.3 | Applied | 240 | 0.35 | ○ | ○ | 0.2 |
| 5 | 51 | Standard | -200 | 300 | -100 | -400 | 1.3 | Applied | 220 | 0.37 | ○ | ○ | 0.2 |
| 6 | 27 | Standard | -500 | 300 | -100 | -400 | 1.3 | Applied | 420 | 0.33 | ○ | △ | 0.2 |
| Comparative Example 1 | 42 | Standard | -300 | — | — | — | — | — | 850 | 0.68 | × | ○ | 0.2 |
| 2 | 21 | Standard | -600 | — | — | — | — | — | 870 | 0.79 | × | ○ | 0.2 |
| 3 | 18 | Low | -300 | — | — | — | — | — | 412 | 0.35 | ○ | × | 0.35 |

IMAGE FORMING APPARATUS AND LUBRICANT APPLICATION METHOD

This application is based on application No. 2013-152714 filed in Japan, the contents of which are hereby incorporated by reference.

BACKGROUND OF THE INVENTION (1) Field of the Invention

The present invention relates to an image forming apparatus that forms an image on a rotative image carrier and transfers the image formed on the image carrier to an object, and to a lubricant application method for applying a lubricant to the circumferential surface of the image carrier.

(2) Related Art

Electrophotographic image forming apparatuses such as printers are configured to electrically charge a photosensitive drum as an example of a rotative image carrier, form an electrostatic latent image by exposing the charged photosensitive drum to light, form a toner image by developing the electrostatic latent image formed on the photosensitive drum, transfer the toner image thus formed onto a recording sheet, and remove a residual material such as toner on the photosensitive drum not transferred to the recording sheet, by using a cleaner.

In such an image forming apparatus, it is common that a lubricant made of zinc stearate for example is applied to the photosensitive drum in order to improve the performance in transfer, cleaning, and so on.

Japanese Patent Application Publication No. 2008-89771 discloses a structure in which: a cleaning device and a lubricant applying device are located in this order around the rotative photoreceptor along the rotational direction thereof; and in the lubricant applying device, a rotative transport brush is brought into contact with a powder lubricant contained in a casing disposed below the transport brush, thereby picking up the lubricant, and the transport brush transports the lubricant to the location facing the photoreceptor, and thus applying the lubricant to the circumferential surface of the photoreceptor.

When the transport brush as described in the publication above is used, a large portion of the powder lubricant picked up from the casing by the transport brush is held by the top of the bristles of the brush, and is brought into contact with the circumferential surface of the photoreceptor, and is thus transported to the circumferential surface of the photoreceptor. However, there also is a portion of the powder lubricant that remains on the bristles of the transport brush, entering deep into the bristles and staying at the bottom of the bristles.

Considering this, the amount of lubricant to be applied to the circumferential surface of the photoreceptor (i.e. supply amount) per rotation of the transport brush can be obtained by subtracting the amount of lubricant staying in the brush (i.e. accumulation amount) from the amount of lubricant picked up by the transport brush (i.e. consumption amount). When the relationship between the supply amount, the accumulation amount, and the consumption amount is constant, a certain amount of lubricant would be allowed to be stably supplied to the circumferential surface of the photoreceptor over a long period.

In reality, however, the amount of lubricant staying deep in the transport brush increases as the cumulative count of rotations of the brush increases. When the bristles are clogged up with lubricant, it is unlikely that a further portion of lubricant enters deep into the brush. The lubricant that cannot enter the brush is only allowed to temporarily stay at the top of the bristles, and is then supplied to the circumferential surface of the photoreceptor.

Therefore, out of the picked-up lubricant (i.e. consumption amount), the amount of lubricant staying in the brush (i.e. the accumulation amount) decreases as the number of the image formation operations that have been executed increases, and accordingly, the amount of application of the lubricant to the circumferential surface of the photoreceptor (i.e. the supply amount) increases. This increase in the amount of supply to the circumferential surface of the photoreceptor progresses gradually over a long period such as several months, and leads to an excess supply of the lubricant.

The excessive lubricant supplied onto the circumferential surface of the photoreceptor is transported to the cleaning device according to the rotation of the photoreceptor. When, for example, the lubricant passes through the point that faces the developing device located around the photoreceptor, there is a high possibility that a portion of the lubricant is mixed into the developer within the developing device.

If a large amount of lubricant is mixed into the developer, it becomes more likely that a developing failure occurs.

SUMMARY OF THE INVENTION

The present invention aims to provide an image forming apparatus that is capable of stably supplying a constant amount of lubricant to an image carrier such as a photosensitive drum over a long period, and a method of applying lubricant to the circumferential surface of the image carrier.

The aim described above is achieved by an image forming apparatus for forming an image on a rotative image carrier and transferring the image onto an object, comprising: a cleaning unit that removes a residual material from the rotative image carrier after the image has been transferred onto the object; and a lubricant applying unit that applies lubricant to a circumferential surface of the rotative image carrier after the residual material has been removed, the lubricant applying unit including: a rotative transporter that picks up and retains lubricant from a lubricant source, transports the lubricant to a lubricant application point, and supplies a portion of the lubricant to the rotative image carrier at the lubricant application point; an ejector that causes the rotative transporter to eject a portion of the lubricant retained by the rotative transporter; a collector that collects the portion of the lubricant ejected from the rotative transporter; and a controller that controls ejection of the portion of the lubricant caused by the ejector so as to maintain the amount of the lubricant retained by the rotative transporter as no greater than a predetermined upper limit.

The aim described above is also achieved by a lubricant application method used by an image forming apparatus that transfers an image formed on a rotative image carrier onto an object, removes a residual material on the rotative image carrier by using a cleaning unit after the image has been transferred onto the object, and applies lubricant to a circumferential surface of the rotative image carrier by using a lubricant applying unit after the residual material has been removed, the lubricant application method comprising: a first step of picking up and retaining lubricant from a lubricant source by using a rotative transporter included in the lubricant applying unit, transporting the lubricant to a lubricant application point, and supplying a portion of the lubricant to the rotative image carrier at the lubricant application point; a second step of controlling ejection of the portion of the lubricant caused by an ejector so as to maintain the amount of the lubricant retained by the rotative transporter to be no greater than a predetermined upper limit; and a third step of collecting the portion of the lubricant ejected from the rotative transporter by using a collector included in the lubricant applying unit.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 12 shows results of image evaluation obtained by durability test conducted on structures configured to perform the lubricant ejection control (Practical Examples) and structures not configured to perform the lubricant ejection control (Comparative Examples);

DESCRIPTION OF PREFERRED EMBODIMENTS

The following describes embodiments of an image forming apparatus and a lubricant application method pertaining to the present invention, by taking a tandem color printer (hereinafter simply referred to as "printer") as an example.

(1) Overall Structure of Printer

Figure 1:
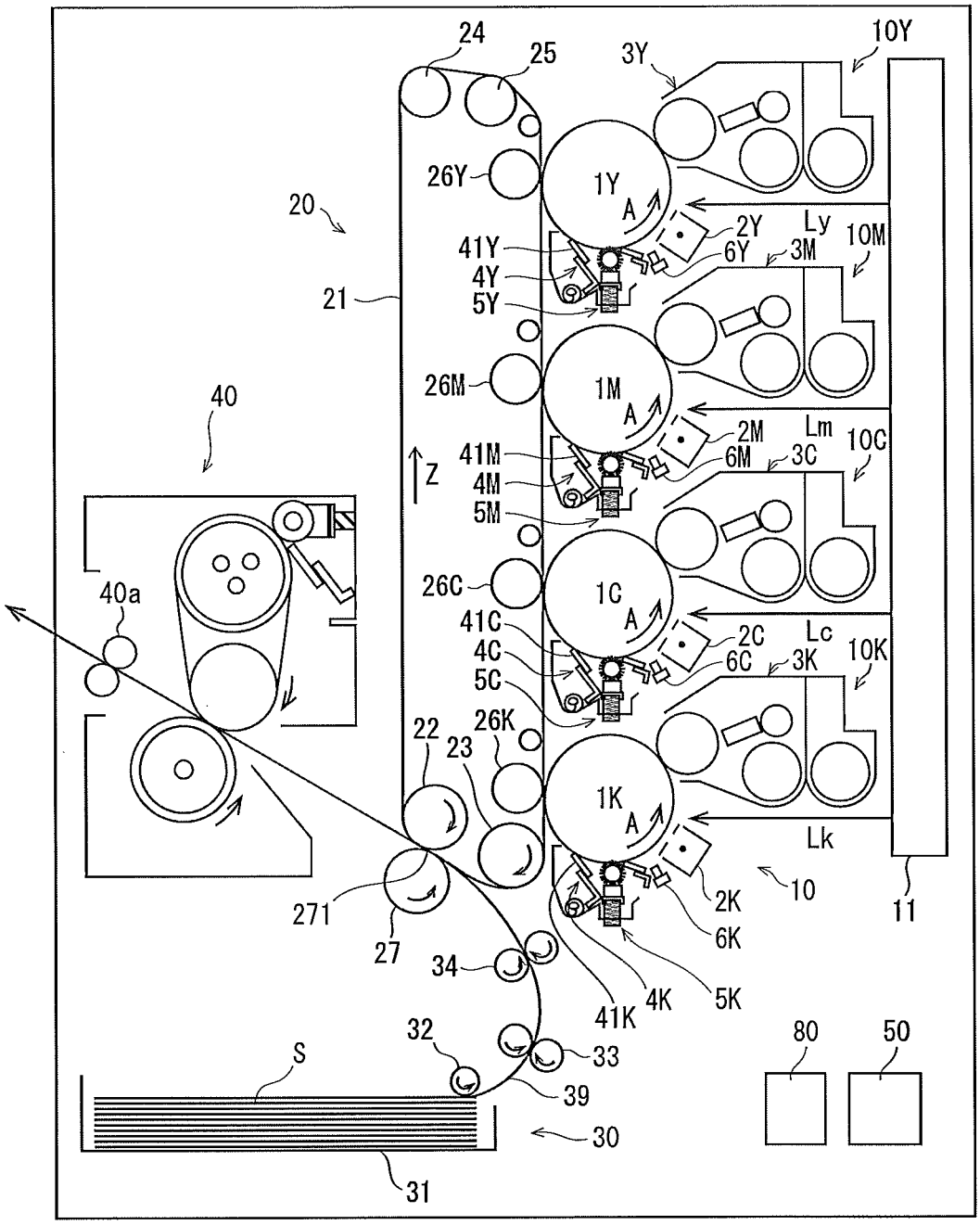
FIG. 1 shows an overall structure of a printer.

FIG. 1 shows an overall structure of a printer;

As shown in the drawing, the printer employs well-known electrophotographic technology to form images, and includes, for example, an image creating unit 10, an intermediate transfer unit 20, a paper feed unit 30, a fixing unit 40, a control unit 50. The printer is connected to a network (e.g. LAN). Upon receipt of an instruction to execute a print job from an external terminal device (not depicted in the drawing), the printer forms a color image composed of yellow, magenta, cyan and black colors according to the instruction. In the following description, the reproduction colors of yellow, magenta, cyan, and black are denoted as "Y", "M", "C" and "K", respectively, and any structural component related to one of the reproduction colors is denoted by a reference sign attached with an appropriate subscript "Y", "M", "C" or "K".

The image creating unit 10 includes image creating units 10Y, 10M, 10C and 10K corresponding to Y, M, C and K colors, and an exposure unit 11.

The image creating units 10Y, 10M, 10C and 10K respectively include, for example, photosensitive drums 1Y, 1M, 1C and 1K serving as image carriers rotating in the direction indicated by the arrow A, charging units 2Y, 2M, 2C and 2K, developing units 3Y, 3M, 3C and 3K, cleaning units 4Y, 4M, 4C and 4K, lubricant applying units 5Y, 5M, 5C and 5K and neutralizing units 6Y, 6M, 6C and 6K, which are located around the photosensitive drums along the rotational direction A of the photosensitive drums, and form toner images of the colors corresponding to the photosensitive drums 1Y, 1M, 1C and 1K.

The intermediate transfer unit 20 includes, for example, an intermediate transfer belt 21, a drive roller 22, passive rollers 23 through 25, primary transfer rollers 26Y, 26M, 26C and 26K respectively facing the photosensitive drums 1Y, 1M, 1C and 1K with the intermediate transfer belt 21 interposed therebetween, and a secondary transfer roller 27 respectively facing the drive roller 22 with the intermediate transfer belt 21 interposed therebetween.

The intermediate transfer belt 21 is suspended with tension between the drive roller 22, the passive rollers 23 through 25 and the primary transfer rollers 26Y through 26K, and is caused to move cyclically in the direction indicated by the arrow Z by the drive force generated by the drive roller 22.

The paper feed unit 30 includes a paper feed cassette 31, a pick-up roller 32, a pair of transport rollers 33 and a pair of timing rollers 34.

The paper feed cassette 31 houses sheets of paper S as recording sheets. The pickup roller 32 picks up the sheets of paper S housed in the paper feed cassette 31 one by one, and feeds each sheet onto a transport passage 39.

The pair of transport rollers 33 transports each of the picked up sheets S downstream in the transport direction of the transport passage 39. The pair of timing rollers 34 adjusts the timing at which each sheet of paper S reaches the secondary transfer point 271 at which the secondary transfer roller 27 is in contact with the intermediate transfer belt 21.

The fixing unit 40 presses the fixing roller and the pressure roller against each other to form a fixing nip, and maintains the temperature required for the fixing by heating the fixing roller by using a heater.

The control unit 50 converts image signals from the external terminal device into image signals corresponding to the Y, C, M and K colors, and generate drive signals for driving the laser diodes (not depicted in the drawing) corresponding to the respective colors disposed in the exposure unit 11. In response to the drive signals thus generated, the exposure unit 11 emits a laser beam Ly for the Y color, a laser beam Lm for the M color, a laser beam Lc for the C color, and a laser beam Lk for the K color, and thus the photosensitive drums 1Y through 1K undergo exposure scanning.

Before undergoing the exposure scanning, the photosensitive drums 1Y through 1K are uniformly charged by the charging units 2Y through 2K after being neutralized by the neutralizing units 6Y through 6K. Due to the laser beams Ly through Lk, an electrostatic latent image is formed on the circumferential surface of each of the photosensitive drums 1Y through 1K.

Each of the photosensitive drums 1Y through 1K has negative charging characteristics. The photosensitive drums 1Y through 1K are charged negatively by the charging units 2Y through 2K, and the areas where the images are formed are exposed to the laser beams Ly through Lk.

The electrostatic latent images are developed by the developing units 3Y through 3K. The toner used here has negative charging characteristics, and a reversal development method is employed. The toner images of the Y through K colors formed on the photosensitive drums 1Y through 1K undergo the primary transfer to the intermediate transfer belt 21 due to the electrostatic force caused between the primary transfer roller 26Y through 26K and the photosensitive drums 1Y through 1K.

The operations for creating the images of the respective colors on the photosensitive drums 1Y through 1K are performed with adjusted timings so that the toner images are formed on the same area of the intermediate transfer belt 21. The toner images of the respective colors undergoing the multiple transfer onto the intermediate transfer belt 21 moves to a secondary transfer point 271 due to the circular running of the intermediate transfer belt 21.

According to the timing of the image creation operations described above, a sheet of paper S is fed from the paper feed unit 30 by the pair of timing rollers 34. The sheet of paper S is transported by the secondary transfer roller 27 and the intermediate transfer belt 21 sandwiching the sheet, and the toner images of the respective colors on the intermediate transfer belt 21 collectively undergo the secondary transfer onto the sheet of paper S at the secondary transfer point 271.

The sheet of paper S, which has passed through the secondary transfer point 271, is transported to the fixing unit 40. When the sheet of paper S passes through the fixing nip, heat and pressure is applied to the toner image, and the toner image is fixed to the sheet of paper S. Then, the sheet of paper S is ejected from the apparatus by the pair of ejection rollers 40*a*.

The residual materials on the photosensitive drums 1Y through 1K, containing, for example, a portion of toner remaining on the photosensitive drums 1Y through 1K after the toner images undergo the primary transfer to the intermediate transfer belt 21, are removed by cleaning blades 41Y, 41M, 41C and 41K of the cleaning units 4Y through 4K.

After the residual materials are removed, a lubricant is applied to the circumferential surfaces of the photosensitive drums 1Y through 1K by the lubricant applying units 5Y through 5K. The lubricant thus applied is transported in the circumferential direction of the photosensitive drums 1Y through 1K by the rotation of the photosensitive drums 1Y through 1K, and reaches the cleaning units 4Y through 4K via the charging units 2Y through 2K, the developing units 3Y through 3K, and so on. The lubricant is thus supplied to the contact points between the cleaning blades 41Y through 41K and the photosensitive drums 1Y through 1K.

As a result, the lubricant reduces the friction between the cleaning blades 41Y through 41K and the photosensitive drums 1Y through 1K, prevents the cleaning blades 41Y through 41K from being worn off within a short period, and improves the performance in cleaning over a long time. Thus, the lubricant realizes a long life by preventing wear of the circumferential surfaces of the photosensitive drums 1Y through 1K. Furthermore, since a lubricant coating intervenes between the circumferential surfaces of the photosensitive drums 1Y through 1K and the toner particles of the toner image after development, the lubricant improves the performance in transfer over a long time.

(2) Structure of Lubricant Applying Unit

Figure 2:
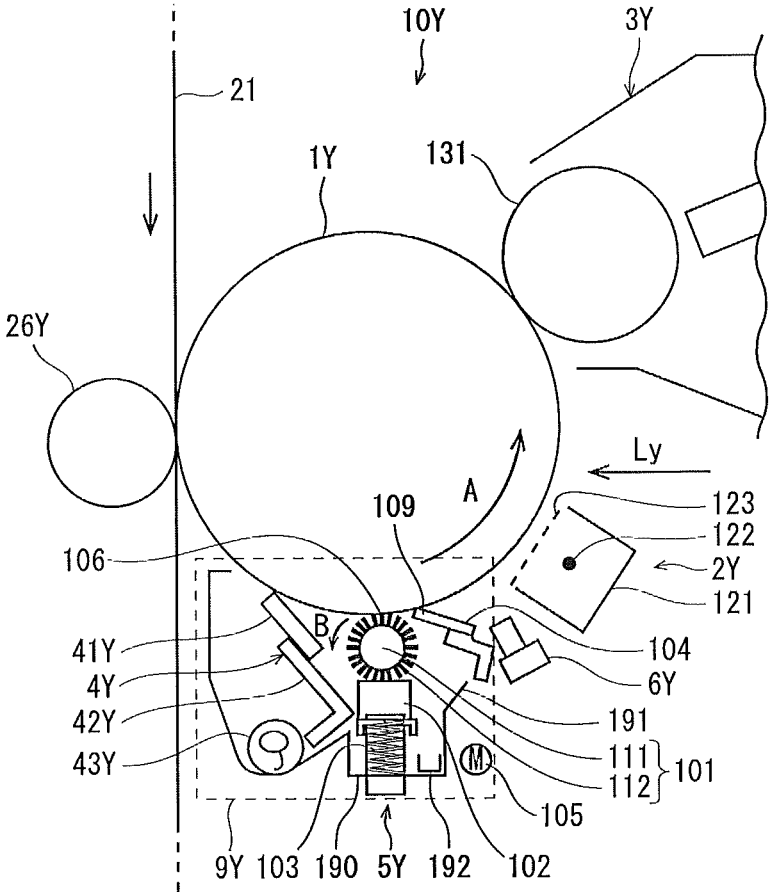
FIG. 2 is an enlarged view showing the structure of a lubricant applying unit included in an image creating unit of the printer.

FIG. 2 is an enlarged view of the lubricant applying unit 5Y of the image creating unit 10Y, which also shows the photosensitive drum 1Y, the cleaning blade 41Y, and so on disposed around the lubricant applying unit 5Y. Since each image creating unit has basically the same structure, the following only describes then structure of the image creating unit 10Y, and the descriptions of the other image creating units, 10M through 10K, are omitted.

As shown in the drawing, the lubricant applying unit 5Y is located downstream from the cleaning unit 4Y in the drum rotational direction A. The cleaning unit 4Y and the lubricant applying unit 5Y are housed within a housing 190 and integrated into a single unit 9Y, and detachably attached to the body of the apparatus.

The cleaning blade 41Y of the cleaning unit 4Y is made from polyurethane rubber shaped into a plate, and is attached to a holder plate metal 42Y by, for example, hot-melt adhesive. The tip of the cleaning blade 41Y is brought into contact with the circumferential surface of the photosensitive drum 1Y and resists against the drum rotating in the rotational direction A, so that the cleaning blade 41Y scrapes the residual material containing the residual toner from the circumferential surface of the photosensitive drum 1Y. The residual material thus scraped falls to a collecting screw 43Y within the housing 190, and is transported to and collected in a discarded toner collection box (not depicted in the drawing) by the collection screw 43Y.

The lubricant applying unit 5Y includes, for example, a brush roller 101, a solid lubricant 102, a compression spring 103, a flattening blade 104, and a brush motor 105.

Note that each of the brush roller 101, the solid lubricant 102, the flattening blade 104, the cleaning blade 41Y and the housing 190 housing these components has an elongated shape along the axial direction (i.e. drum axis direction) of the photosensitive drum 1Y, and, in the axis direction, has a length longer than the width in the horizontal scanning direction (i.e. the printing width) of the image formation area of the photosensitive drum 1Y. The compression springs 103 are disposed at intervals along the drum axis direction.

The brush roller 101 is formed from a core bar 111 made of electrically conductive metal material such as steel and a brush (brush bristles) 112 composed of a large number of conductive bristles formed on the circumferential surface of the core bar 111. The brush roller 101 is interposed between the photosensitive drum 1Y and the solid lubricant 102. The portion of the brush fiber 112 facing the circumferential surface of the photosensitive drum 1Y is brought in contact with the circumferential surface of the photosensitive drum 1Y and thus the lubricant is applied (supplied) to the circumferential surface of the photosensitive drum 1Y. The contact point between the brush roller 101 and the circumferential surface of the photosensitive drum 1Y is the application point 106 at which the lubricant is applied to the photosensitive drum 1Y.

The core bar 111 is rotated (in the direction indicated by the arrow B) to be counter to the drum rotation at the application point 106, due to the drive force of the brush motor 105. The rotation speed of the brush roller 101 is determined such that, during the image formation operations, the linear velocity of the tips of the bristles 112 along the rotational direction of the core bar 111 has a predetermined ratio to the constant speed of the circumferential surface of the photosensitive drum 1Y. This predetermined ratio is, for example, 0.7. This ratio is called rotation speed ratio R.

The brush bristles 112 are composed of straight bristles and loop bristles combined in predetermined proportions. Each of the straight bristles is made of conductive acrylic material having an electrical resistivity of $10^6\Omega$, a thickness of 4T decitex, and a density of 115 KF/in$^2$. Each of the loop bristles is made of conductive polyester material having an electrical resistivity of $10^8\Omega$, a thickness of 3T decitex, and a density of 225 KF/in$^2$.

The diameter of the core bar 111 is 6 mm, and the height of the straight bristles and the loop bristles constituting the brush bristles 112 is approximately 2.5 mm. The brush bristles 112 are weaved into an electrically conductive base cloth (not depicted in the drawing) wound around the core bar 111. Since the base cloth has a thickness of approximately 0.5 mm, the brush roller 101 has a diameter of approximately 12 mm.

The solid lubricant 102 is formed by melting and molding a metal soap powder made of metal salt of fatty acid. The metal salt used here is, for example, zinc stearate having negative triboelectric charging characteristics.

The zinc stearate is preferable because it has a high releasability (corresponding to a large pure water contact angle) and a small friction coefficient, and exhibits high performance in transferring and cleaning. However, the use of zinc stearate is not essential.

For example, the following metal salts may be used as the lubricant: metal stearate such as aluminum stearate, copper stearate, and magnesium stearate; metal oleate such as zinc oleate, manganese oleate, iron oleate, copper oleate, and magnesium oleate; metal palmitate such as zinc palmitate, copper palmitate, and magnesium palmitate; metal linoleate such as zinc linoleate; and metal ricinoleate such as zinc ricinoleate and lithium ricinoleate.

The compression springs 103 press the solid lubricant 102 against the brush roller 101. The solid lubricant 102 pressed against the brush roller 101 is scraped by each of the brush bristles due to the rotation of the brush roller 101. The lubricant thus scraped is transported to the application point 106 due to the rotation of the brush roller 101, and is provided to the photosensitive drum 1Y.

The flattening blade 104 is made from polyurethane rubber shaped into a sheet, and is located downstream from the brush roller 101 in the drum rotation direction. The tip 109 of the flattening blade 104 is brought into contact with the circumferential surface of the photosensitive drum 1Y and resists against the rotation of the photosensitive drum 1Y. The flattening blade 104 flattens the lubricant supplied onto the circumferential surface of the photosensitive drum 1Y by allowing the lubricant to pass through the gap formed with the circumferential surface of the photosensitive drum 1Y. Thus, the flattening blade 104 generates a coating film of lubricant having a uniform thickness on the photosensitive drum 1Y.

(3) Detailed Descriptions of Application of Lubricant

Figure 3:
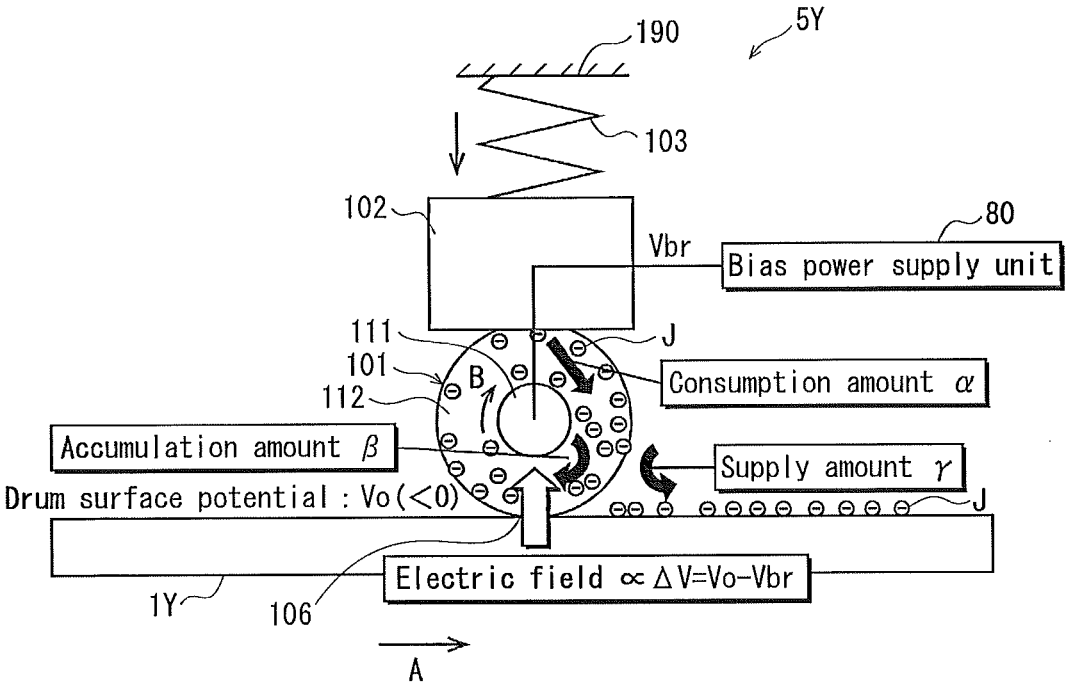
FIG. 3 schematically shows the application of the lubricant performed by a brush roller of the lubricant applying unit.

FIG. 3 schematically shows the application of lubricant performed by the brush roller 101.

As shown in the drawing, the brush roller 101 is located such that the parts of the brush bristles 112 of the brush roller 101 that face the solid lubricant 102 come into contact with the solid lubricant 102 and the parts facing the photosensitive drum 1Y come into contact with the circumferential surface of the photosensitive drum 1Y at the application point 106.

Due to the rotation of the brush roller 101, the surface of the solid lubricant 102 is scraped by the brush bristles 112. A portion J of the lubricant thus scraped is negatively charged by friction caused between the brush bristles 112 and the solid lubricant 102.

The lubricant J thus negatively charged enters and is held by the brush bristles 112, and is transported to the circumferential surface of the photosensitive drum 1Y due to the rotation of the brush roller 101.

A large portion of the lubricant J transported to the circumferential surface of the photosensitive drum 1 is then transported (supplied) onto the circumferential surface of the photosensitive drum 1Y, and the remaining portion of the lubricant J stays in the brush bristles 112.

The transportation of the lubricant J from the brush roller 101 to the photosensitive drum 1Y is realized by utilizing the mechanical attachment force caused by the brush bristles 112 sliding on the circumferential surface of the photosensitive drum 1Y as well as by applying the electrostatic force, caused by the electric field generated between the brush roller 101 and the photosensitive drum 1Y, to the lubricant J negatively charged.

According to the present embodiment, a bias voltage Vbr is applied (supplied) from the bias power supply unit 80 to the metal core 111 of the brush roller 101 to generate a potential difference ΔV between the brush roller 101 and the circumferential surface of the photosensitive drum 1Y, and this potential difference ΔV generates the electric field between the circumferential surface photosensitive drum 1Y and the brush roller 101. The potential difference ΔV is the difference between the electric potential of the brush roller 101 resulting from the application of the bias voltage Vbr and the electric potential Vo (<0) of the circumferential surface of the photosensitive drum 1Y (drum surface potential), and can be represented by Vo−Vbr.

For example, when the potential difference ΔV is greater than 0, the negatively charged lubricant J is under the influence of the electrostatic force acting in the direction from the brush roller 101 to the photosensitive drum 1Y, and the lubricant J held by the brush bristles 112 is likely to move to the photosensitive drum 1Y.

In contrast, when the potential difference ΔV is smaller than 0, the negatively charged lubricant J is under the influence of the electrostatic force acting in the direction from the photosensitive drum 1Y to the brush roller 101, and the lubricant J held by the brush bristles 112 is unlikely to move to the photosensitive drum 1Y, and is likely to be accumulated in the brush bristles 112.

Therefore, the amount of lubricant to be supplied from the brush roller 101 to the photosensitive drum 1Y can be changed by changing the potential difference ΔV. According to the present embodiment, the drum surface potential Vo after the cleaning is substantially constant at, for example, −100 V, and the present embodiment is configured to change the amount of the lubricant J by changing the bias voltage Vbr.

When a consumption amount α denotes the amount of the lubricant J scraped from the solid lubricant 102 per unit operation of the brush roller 101, a supply amount γ denotes the amount of a portion of the lubricant J moving from the brush roller 101 to the photosensitive drum 1Y, and an accumulation amount β denotes the amount of the remaining portion of the lubricant J remaining in the brush roller 101 without moving to the circumferential surface of the photosensitive drum 1Y, Equation 1 below is satisfied:

$$\text{Supply Amount } \gamma = (\text{Consumption Amount } \alpha - \text{Accumulation Amount } \beta) \quad \text{(Equation 1)}$$

As described above, the amount of the lubricant J accumulated in the brush bristles 112 gradually increases as the cumulative count of the rotations of the brush roller 101 increases, and as the amount of the accumulated lubricant J increases, the brush bristles 112 are likely to be clogged up with the lubricant J. When the bristles are clogged up with lubricant, it is unlikely that a further portion of lubricant enters deep into the brush bristles 112.

If it is unlikely that a further portion of the lubricant enters deep into the brush bristles 112, the accumulation amount β decreases. Therefore, when the consumption amount α is constant, the supply amount γ increases according to the decrease of the accumulation amount β.

If the supply amount γ gradually increases over a long period such as several months, the supply amount γ supplied to the photosensitive drum 1Y will be excessive.

The lubricant J supplied to the photosensitive drum 1Y is transported to the flattening blade 104 due to the rotation of the photosensitive drum 1Y. The flattening blade 104 forms a coating film of the lubricant J. However, unlike the cleaning blade 41Y, the flattening blade 104 does not actively scrapes off the residual material. Therefore, while flattening the lubricant J, the flattening blade 104 is likely to allow the lubricant J to pass over a long period until the amount of the lubricant J becomes too excessive to pass through the gap with the photosensitive drum 1Y.

If the supply amount γ of the lubricant J supplied to the photosensitive drum 1Y increases, and if a portion of the lubricant J flies off the photosensitive drum 1Y and attaches to a charging wire 122 (FIG. 2) of a shield cable 121 (FIG. 2) of the charging unit 2Y or a grid electrode 123 (FIG. 2), or is mixed in the developer within the developing unit 3Y via the developing roller 131 (FIG. 2) of the developing unit 3Y during the transportation of the lubricant J to the cleaning blade 41Y via the flattening blade 104 due to the rotation of the photosensitive drum 1Y, it becomes likely that the lubricant J causes a charging failure or a developing failure.

The phenomenon that the supply amount γ of the lubricant J supplied to the photosensitive drum 1Y gradually increases over a long period is caused by that the amount of accumulation β gradually decreases according to the increase in amount of the lubricant J accumulated in the brush bristles 112 of the brush roller 101.

Considering this fact, the present embodiment is configured to forcibly eject the lubricant J continuously accumulated in the brush bristles 112 of the brush roller 101 and collect the ejected lubricant J by using the lubricant applying unit 5Y, thereby maintaining the appropriate balance between the supply amount γ and the accumulation amount β over a long period, realizing stable supply of the lubricant J to the photosensitive drum 1Y over a long period, and preventing the ejected lubricant J from being a cause of a charging failure or a developing failure.

The ejection control for ejecting the lubricant J is realized by controlling the potential difference ΔV and the rotation speed of the brush roller 101. The following specifically describes the ejection control.

(4) Lubricant Ejection Control

Figure 4:
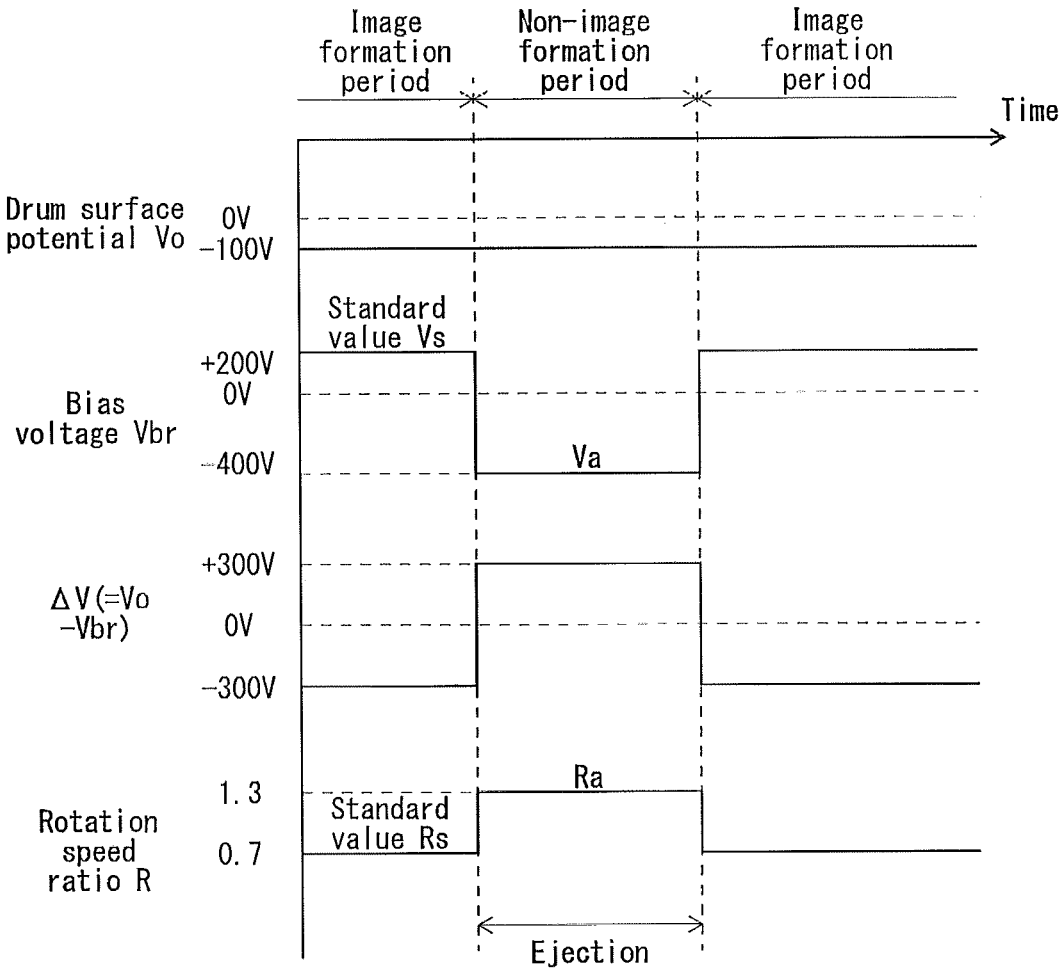
FIG. 4 shows an example timing chart of lubricant ejection control.

FIG. 4 is an example timing chart of the lubricant ejection control, and shows that the potential difference ΔV between the brush roller 101 and the circumferential surface of the photosensitive drum 1Y, and the rotation speed of the brush roller 101 are changed according to whether the ejection control is performed or not.

Here, the image formation period shown in the drawing means a period for which a print job is executed and image formation is performed by the image creating unit 10Y. Specifically, a series of processes including charging, exposing, developing and transferring are performed during this period.

The non-image formation period ("sheet interval") is a period for which a print job is executed but image formation is not performed by the image creating unit 10Y. Specifically, the non-image formation period corresponds to a period from the time at which image formation on the $n^{th}$ sheet of the paper S completes to the time at which image formation on the $(n-1)^{th}$ sheet of the paper S begins. Here, it is assumed that a plurality of sheets of paper S are continuously fed at intervals.

Note that the non-image formation period includes: a start-up period from the beginning of the driving to the beginning of the image formation on a sheet of paper S; and a termination period from the completion of the image formation to the termination of the driving.

In both the image formation period and the non-image formation period (sheet interval), the photosensitive drum 1Y and the brush roller 101 are rotated during execution of a print job. The drum surface potential Vo is the electric potential at the application point 106 on the circumferential surface of the photosensitive drum 1Y, to which the lubricant J is applied by the brush roller 101. It is assumed here that the drum surface potential Vo is −100 V, for example.

It is also assumed that the lubricant ejection control is performed during the non-image formation period (sheet interval). However, the lubricant ejection control is not performed in every non-image formation period (sheet interval), and is performed only when a predetermined execution condition (described later) is satisfied.

As shown in the drawing, during the image formation period, the drum surface potential Vo is −100 V, the bias voltage Vbr is +200 V (=standard value Vs), the potential difference ΔV (=Vo−Vbr) is −300 V, and the rotation speed ratio R is 0.7 (=standard value Rs).

Since the potential difference ΔV is a negative value, the lubricant J (negatively charged) held by the brush roller 101 is under the influence of electrostatic force acting toward the brush roller 101. However, the lubricant J is supplied from the brush roller 101 to the circumferential surface of the photosensitive drum 1Y due to the mechanical attachment force caused by the brush bristles 112 which are brought into contact with the circumferential surface of the photosensitive drum 1Y. The bias voltage Vbr, the rotation speed ratio R, and the pressure of the brush roller 101 against the photosensitive drum 1Y are determined such that the supply amount will be appropriate for the desired performance in transferring and cleaning during the image formation.

On the other hand, during the non-image formation period (sheet interval), the drum surface potential Vo is kept at −100 V, whereas the bias voltage Vbr is changed to a control value Va (=−400V), which is lower than the standard value Vs (=+200 V), and thus the potential difference ΔV becomes +300V. Furthermore, the rotation speed ratio R is changed to a control value Ra (−4.3), which is larger than the standard value Rs (=0.7).

Since the potential difference ΔV becomes positive, the lubricant J held by the brush roller 101 will be put under the influence of the electrostatic force acting toward the photosensitive drum 1Y. Furthermore, the mechanical attachment force is also applied. Therefore, the supply amount γ of the lubricant J will be much greater than in the case of the image formation.

In addition, since the rotation speed ratio R is greater than in the case of the image formation, the rotation speed of the brush roller 101 is high, and accordingly the contact area per unit time between the brush bristles 112 and the circumferential surface of the photosensitive drum 1Y, extending along the rotational direction, is large. Therefore, the supply amount γ of the lubricant J is much greater than in the case of the image formation.

In this way, due to the lubricant ejection control performed during the non-image formation period (sheet interval), a much larger amount of lubricant J compared to the supply amount γ in the case of the image formation moves from the brush roller 101 to the circumferential surface of the photosensitive drum 1Y at once (lubricant ejection operation).

At this moment, the supply amount of the lubricant J is greater than the amount that the flattening blade 104 can handle per unit time. Therefore, the lubricant J that the flattening blade 104 cannot handle will not be supplied to the photosensitive drum 1Y but be collected (discarded).

Figure 5:
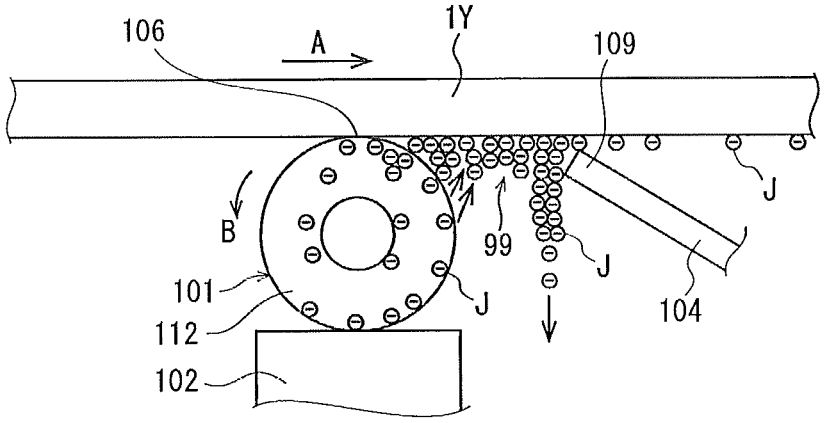
FIG. 5 is a schematic diagram showing execution of lubricant ejection.

FIG. 5 is a schematic diagram showing execution of lubricant ejection, and shows an example case where a large amount of lubricant J forcibly ejected from the brush roller 101 adheres to the circumferential surface of the photosensitive drum 1Y (as indicated by the reference number 99).

The lubricant J ejected onto the circumferential surface of the photosensitive drum 1Y reaches the flattening blade 104 due to the rotation of the photosensitive drum 1Y. However, most of the lubricant J cannot pass through the gap between the tip 109 of the flattening blade 104 and the circumferential surface of the photosensitive drum 1Y, and falls due to the gravity. The lubricant J thus fallen enters the housing 190 via the opening 191 (FIG. 2) of the housing 190, and is collected by the receiver 192 (FIG. 2) provided on the bottom surface of the housing 190.

Due to this lubricant ejection operation, a large portion of the lubricant J accumulated in the brush bristles 112 of the brush roller 101 is ejected from the brush bristles 112. Therefore, the lubricant J clogged up in the brush bristles 112 is released, and the decrease in accumulation amount β (FIG. 3), caused by the constant accumulation of the lubricant J, is prevented. As a consequence, the supply amount γ of the lubricant J supplied to the photosensitive drum 1Y will be stable for a long period.

Most of the lubricant J ejected from the brush roller 101 is collected by the receiver 192 located below the point where the flattening blade 104 faces the photosensitive drum 1Y. Therefore, most of the lubricant J ejected from the brush roller 101 is not supplied to the circumferential surface of the photosensitive drum 1Y. Thus, the lubricant J is prevented from attaching to the charging wire 122 of the charging unit 2Y or being mixed in the developer within the developing unit 3Y and is prevented from causing a charging failure or a developing failure.

Returning to FIG. 4, after the transition from the non-image formation period (sheet interval) to the image formation period, the bias voltage Vbr and the rotation speed ratio R are reset to the standard values Vs and Rs, respectively. The operations for the ejection of the lubricant J are controlled by the control unit 50 for each of the image creating units 10Y through 10K according to the amount G of the lubricant J currently retained by the brush bristles 112 (i.e. retained-lubricant amount G).

(5) Structure of Control Unit

Figure 6:
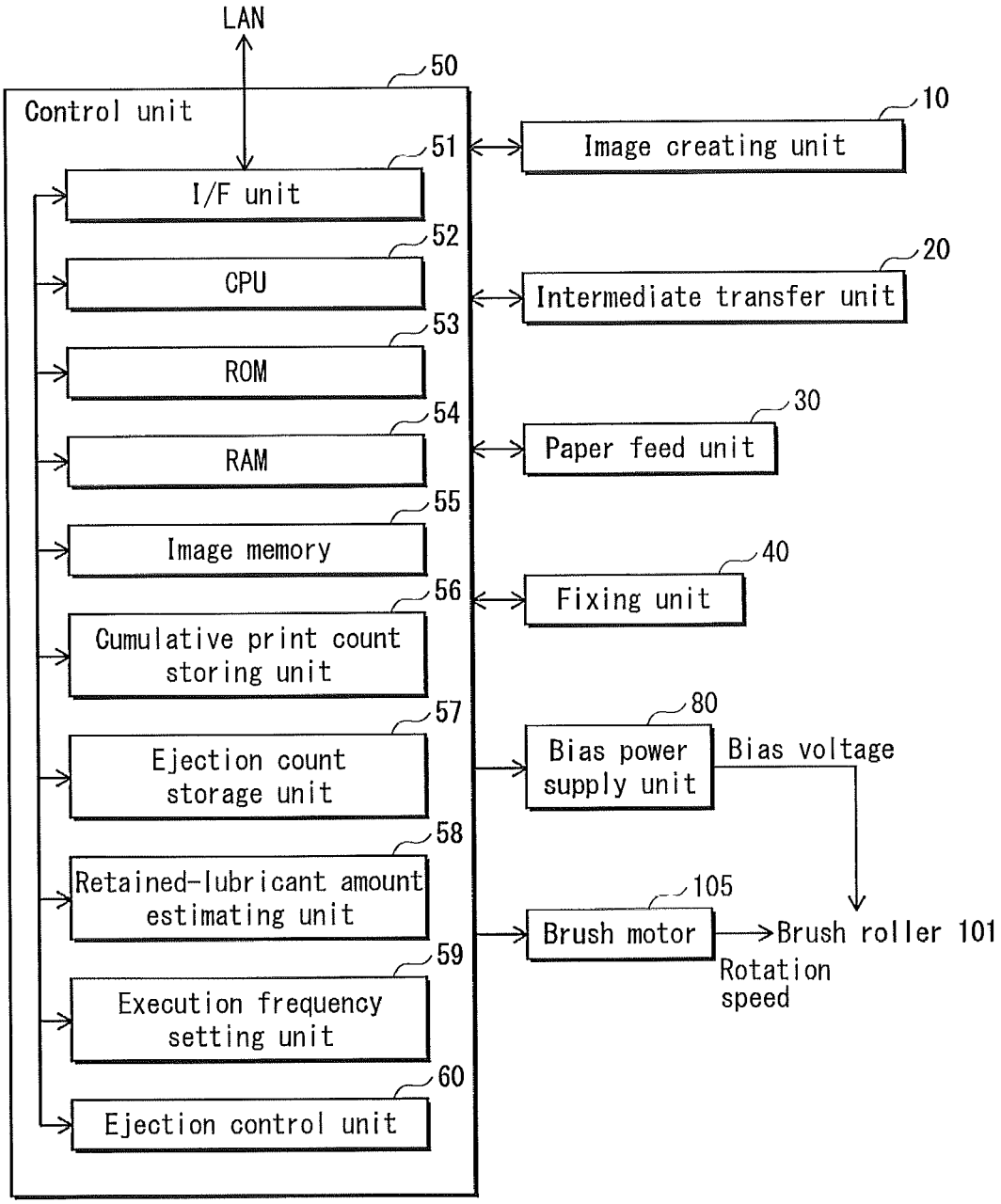
FIG. 6 is a block diagram showing components of a control unit.

FIG. 6 is a block diagram showing the structure of the control unit 50.

As shown in the drawing, the control unit 50 includes mainly a communication interface (I/F) unit 51, a CPU 52, a ROM 53, a RAM 54, an image memory 55, a cumulative print count storing unit 56, an ejection count storage unit 57, a retained-lubricant amount estimating unit 58, an execution frequency setting unit 59, and an ejection control unit 60, for example. These units are configured to exchange signals and data pieces with each other.

The communication I/F 51 is an interface such as a LAN card or a LAN board used for connecting to a network (assumed as a LAN in this example). The communication I/F 51 receives a print job data from an external terminal via the LAN, and stores the data into the image memory 55. The print job data contains header information in addition to the print data used for image formation. The header information includes the number of pages, the number of prints, and so on.

The ROM 53 stores, for example, programs for executing a print job.

The CPU 52 reads a necessary program from the ROM 53, and controls the image creating unit 10, the intermediate transfer unit 20, the paper feed unit 30, the fixing unit 40 to execute the print job based on the print job data stored in the image memory 55.

The RAM 54 serves as a work area for the CPU 52.

The cumulative print count storing unit 56 stores data indicating a cumulative print count P, which indicates the number of sheets S that have been printed so far. The cumulative print count P is updated by being incremented by 1 every time the image formation is performed on a single sheet S. This updating is performed by the CPU 52.

The ejection count storage unit 57 stores data indicating a cumulative execution count Q, which indicates the number of times the ejection of the lubricant J has been performed. The cumulative execution count Q is updated when the ejection of the lubricant J is performed.

The retained-lubricant amount estimating unit 58 estimates the retained-lubricant amount G of the lubricant J retained by the brush roller 101. The details of this estimation process are described below.

The execution frequency setting unit 59 sets the execution frequency E based on the retained-lubricant amount G of the lubricant J estimated by the retained-lubricant amount estimating unit 58. The execution frequency E indicates how often the ejection of the lubricant J is to be performed.

The ejection control unit 60 controls the operations for the ejection of the lubricant J.

(6) Frequency of Execution of Lubricant Ejection Operation

Figure 7:
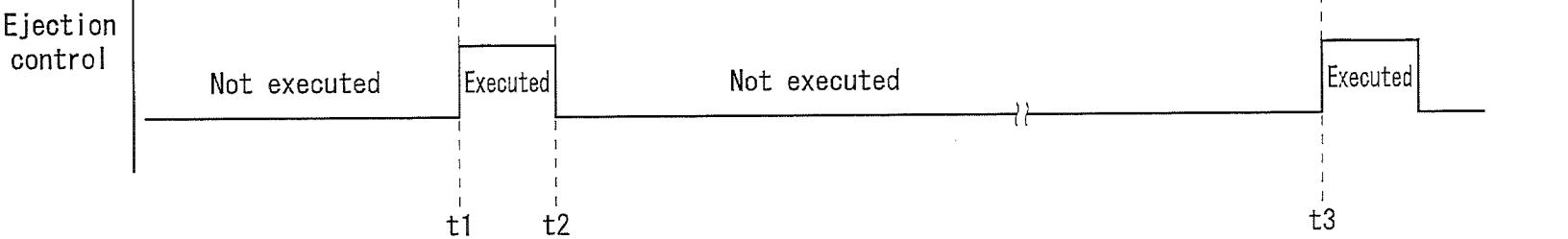
FIG. 7 shows an example timing chart of the lubricant ejection.

FIG. 7 is a timing chart of the lubricant ejection control in the case where the execution frequency E is once per m sheets. In the drawing, $n^{th}$ sheets, $(n+1)^{th}$ sheets, $(n+2)^{th}$ sheets, etc. mean that the cumulative print count is incremented by 1 at a time.

As shown in the drawing, the lubricant ejection operation is performed during the non-image formation period (sheet interval) between when the image formation on the $n^{th}$ sheet completes (time point t1) and when the image formation on the $(n+1)^{th}$ sheet begins (time point t2). From then on, however, the lubricant ejection operation is not performed in any of the non-image formation periods (sheet intervals) until the image formation on the $(n+m)^{th}$ sheet completes. Note that a lubricant ejection operation performed during a single non-image formation period (sheet interval) is counted as a single lubricant ejection operation.

The execution frequency E increases as m decreases. Conversely, the execution frequency E decreases as m increases. For example, when the execution frequency E is once per 20 sheets (m=20), the lubricant ejection operation is performed once every time the image formation has been performed on 20 sheets.

The execution frequency E is determined by experiments or simulations based on the relationship between the retained-lubricant amount G of the lubricant retained by the brush roller 101 and an appropriate range F of the retained-lubricant amount G.

(7) Specific Examples of Execution Frequency of Lubricant Ejection Operation

Figure 8:
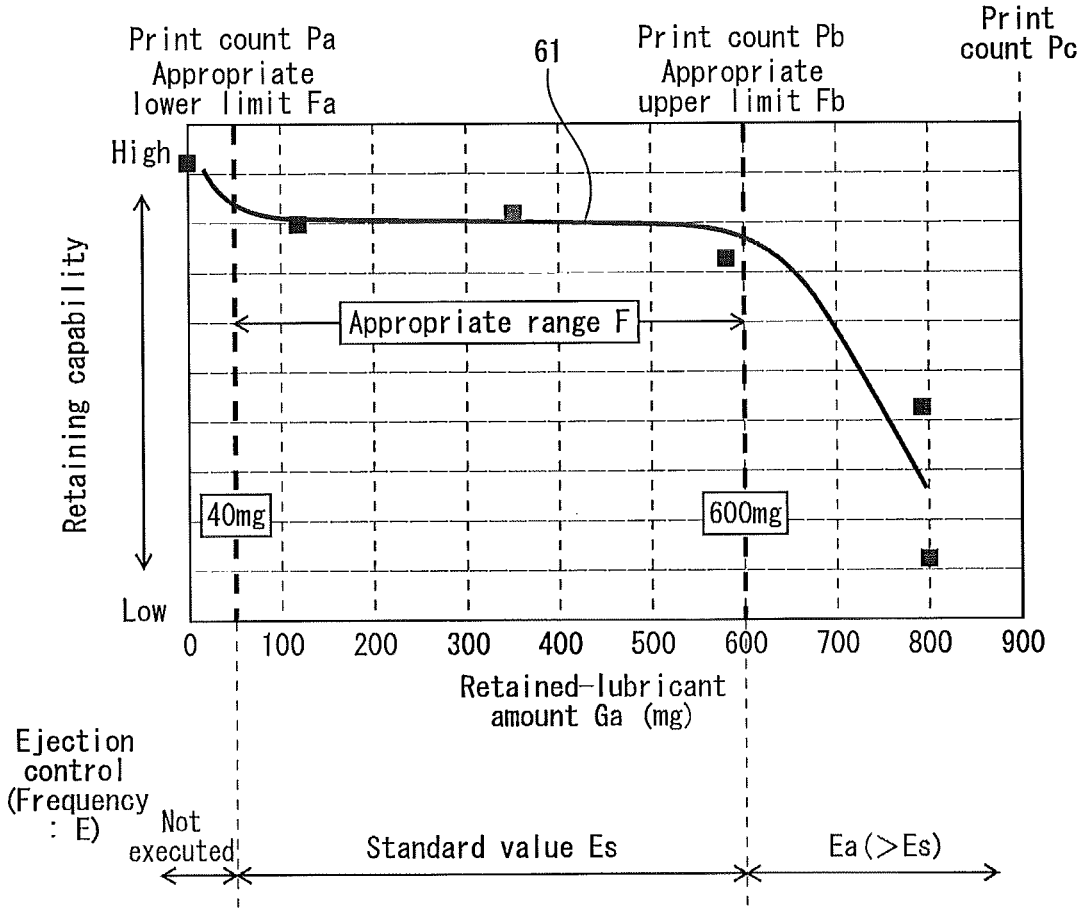
FIG. 8 shows a graph representing the relationship between the amount of retained lubricant and performance in the retaining, and the relationship between the amount of retained lubricant, an approximate range, and a frequency of executions.

FIG. 8 shows a graph 61 representing the relationship between the retained-lubricant amount and the performance in retaining, and the relationship between the retained-lubricant amount, the approximate range F, and the execution frequency E.

The graph 61 shown in the drawing is obtained by an experiment in which an image having a fixed density is printed on 300 k (k=1000) sheets of paper S by using a printer that is provided with the brand-new brush roller 101 and does not perform the lubricant ejection operation. The horizontal axis shows a retained-lubricant amount Ga and the vertical axis shows retaining capability Gb.

Note that the pressure of the compression spring 103 has been adjusted such that the consumption amount $\alpha$ of the lubricant J supplied from the solid lubricant 102 to the brush roller 101 per a predetermined number of rotations of the brush roller 101 will be kept constant during the period between the beginning and the completion of the experiment.

Note that the retained-lubricant amount Ga, which is represented on the horizontal axis, indicates the total amount of the lubricant J actually retained by the brush bristles 112 of the brush roller 101, which is measured in units of milligrams (mg).

The retained-lubricant amount Ga is measured per 2 k sheets. The retaining capability Gb, which is represented on the vertical axis, indicates the increase in the retained-lubricant amount Ga (mg) during the period from the previous measurement to the current measurement.

A large increase in the retained-lubricant amount Ga means that a large amount of lubricant has been accumulated in the brush bristles 112 during the printing on 2 k sheets of paper S, and therefore means that the performance in retaining is high. Conversely, a small increase in the retained-lubricant amount Ga means that a small amount of lubricant has been accumulated in the brush bristles 112 during the printing on 2 k sheets of paper S, and therefore means that the performance in retaining is low.

As seen from the graph 61, the retaining capability Gb is high while the retained-lubricant amount Ga is within the range of 0 mg to 40 mg, and is constant while the retained-lubricant amount Ga is within the range of 40 mg to 600 mg. The retaining capability Gb sharply decreases after the retained-lubricant amount Ga exceeds 600 mg.

The period during which the retained-lubricant amount Ga is within the range of 0 mg to 40 mg corresponds to the period from the beginning of the experiment to when the print count reaches Pa (approximately 10 k). The period during which the retained-lubricant amount Ga is within the range of 40 mg to 600 mg corresponds to the period from when the print count is Pa to when the print count is Pb (approximately 200 k). The period during which the retained-lubricant amount Ga is greater than 600 mg corresponds to the period from when the print count is Pb to when the print count is Pc (300 k).

At the beginning of the experiment, no lubricant J at all is accumulated in the brush bristles 112 of the brush roller 101 which is brand-new, and therefore the retained-lubricant amount Ga is 0. During the period until the print count reaches 2 k, the retaining amount $\beta$ is relatively large compared to the supply amount $\gamma$, and hence the retaining capability Gb in this period is the largest.

During the period until the print count reaches Pa, the amount or the lubricant J accumulated in the brush bristles 112 gradually increases. Therefore, the retaining amount $\beta$ gradually decreases, and accordingly the retaining capability Gb gradually decreases.

When the print count exceeds Pa and the retained-lubricant amount Ga reaches 40 mg and accordingly the amount of lubricant J accumulated in the brush bristles 112 reaches a certain amount, the retaining amount $\beta$ and the supply amount $\gamma$ come into balance, and the retaining capability Gb becomes stable at a certain level.

As the print count approaches to Pb, the retained-lubricant amount Ga gradually increases (i.e. the amount of lubricant J accumulated in the brush bristles 112 gradually increases). Accordingly the proportion of the retaining amount $\beta$ gradually decreases, and the proportion of the supply amount $\gamma$ gradually increases. After the retained-lubricant amount Ga comes within the range of 500 mg to 600 mg, the retaining capability Gb tends to gradually decrease.

After the print count exceeds Pb, the amount of the lubricant J accumulated in the brush bristles 112 is excessive, and the decrease in the retaining amount $\beta$ and the increase in the supply amount $\gamma$ become noticeable. As a consequence, the retaining capability Gb drops sharply.

The decrease in the retaining capability Gb means the increase in the supply amount $\gamma$ when the consumption amount $\alpha$ is constant, and therefore the supply amount of the lubricant J to the photosensitive drums 1Y through 1K becomes excessive. This would lead to the above-mentioned charging failure or developing failure.

According to the present embodiment, the appropriate range F of the retained-lubricant amount Ga, within which the retaining capability Gb is constant, is determined in advance with reference to the graph 61. In this example, the lower limit Fa is set to 40 mg and the upper limit Fb is set to 600 mg. The lubricant ejection operation is performed during the non-image formation period (sheet interval) such that the retained-lubricant amount Ga falls within the appropriate range F.

Specifically, (a) when the retained-lubricant amount Ga is within the appropriate range F, the execution frequency E of the lubricant ejection operation is set to a standard value Es so that the retained-lubricant amount Ga can be kept within the appropriate range F.

(b) When the retained-lubricant amount Ga exceeds the upper limit Fb, the execution frequency E of the lubricant ejection operation is changed to Ea greater than the standard value Es to increase the amount of the lubricant J ejected from the brush roller 101, thereby reducing the retained-lubricant amount Ga so as to be within the appropriate range F.

(c) When the retained-lubricant amount Ga falls below the lower limit Fa, the lubricant ejection control is prohibited to increase the amount of the lubricant J retained by the brush roller 101, thereby increasing the retained-lubricant amount Ga so as to be within the appropriate range F.

In the lubricant ejection control, if the lubricant ejection operation is performed once every time the image formation has been performed on m sheets of paper S, the standard value Es of the execution frequency corresponds to m=200 for example, and Ea corresponds to m=20 for example. In this case, when the retained-lubricant amount Ga exceeds the upper limit Fb, the execution frequency E of the lubricant ejection operation becomes 10 times the execution frequency E in the case where the retained-lubricant amount Ga is within the appropriate range F.

(8) Details of Lubricant Ejection Control

Figure 9:
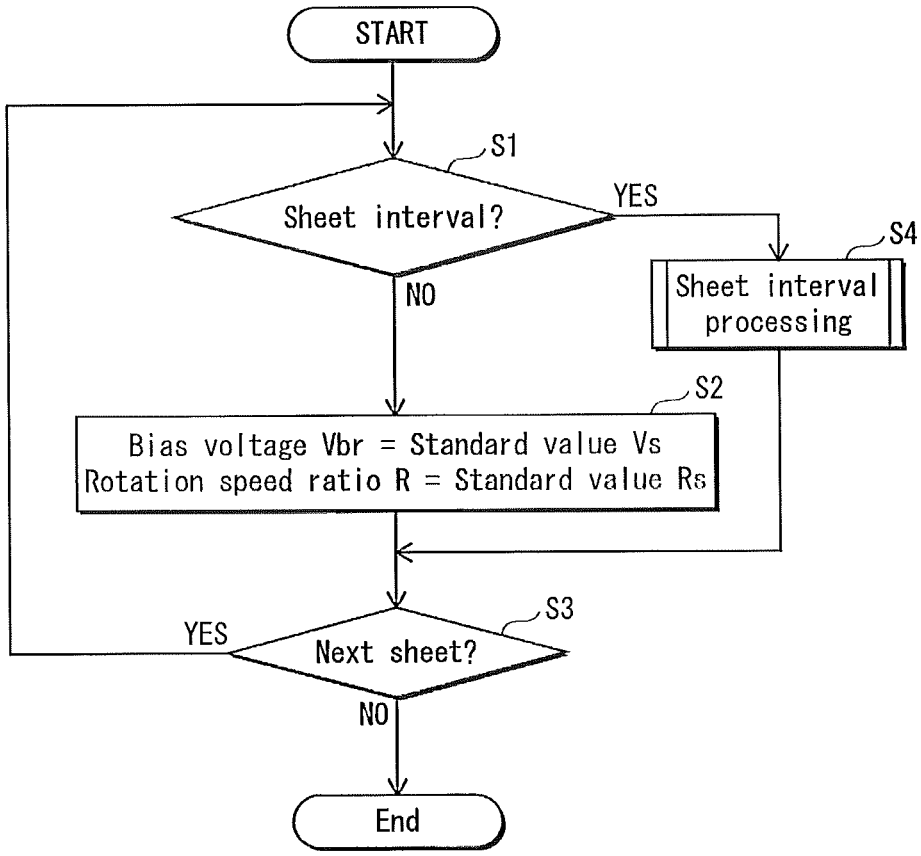
FIG. 9 is a flowchart showing lubricant supply control including lubricant ejection control.
Figure 10:
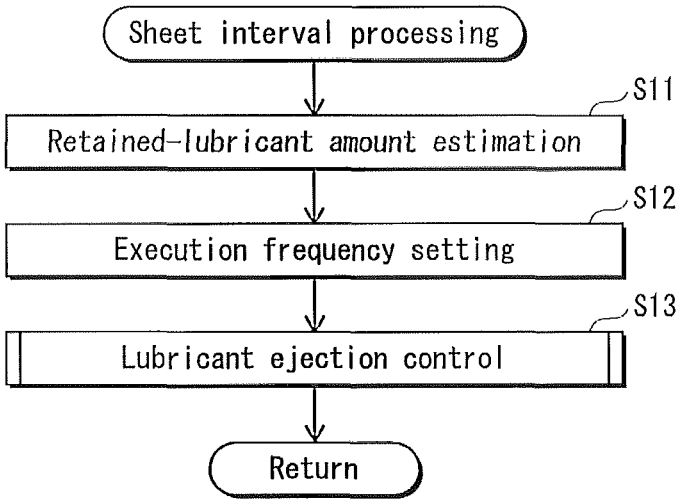
FIG. 10 is a flowchart showing a subroutine for sheet interval processing.
Figure 11:
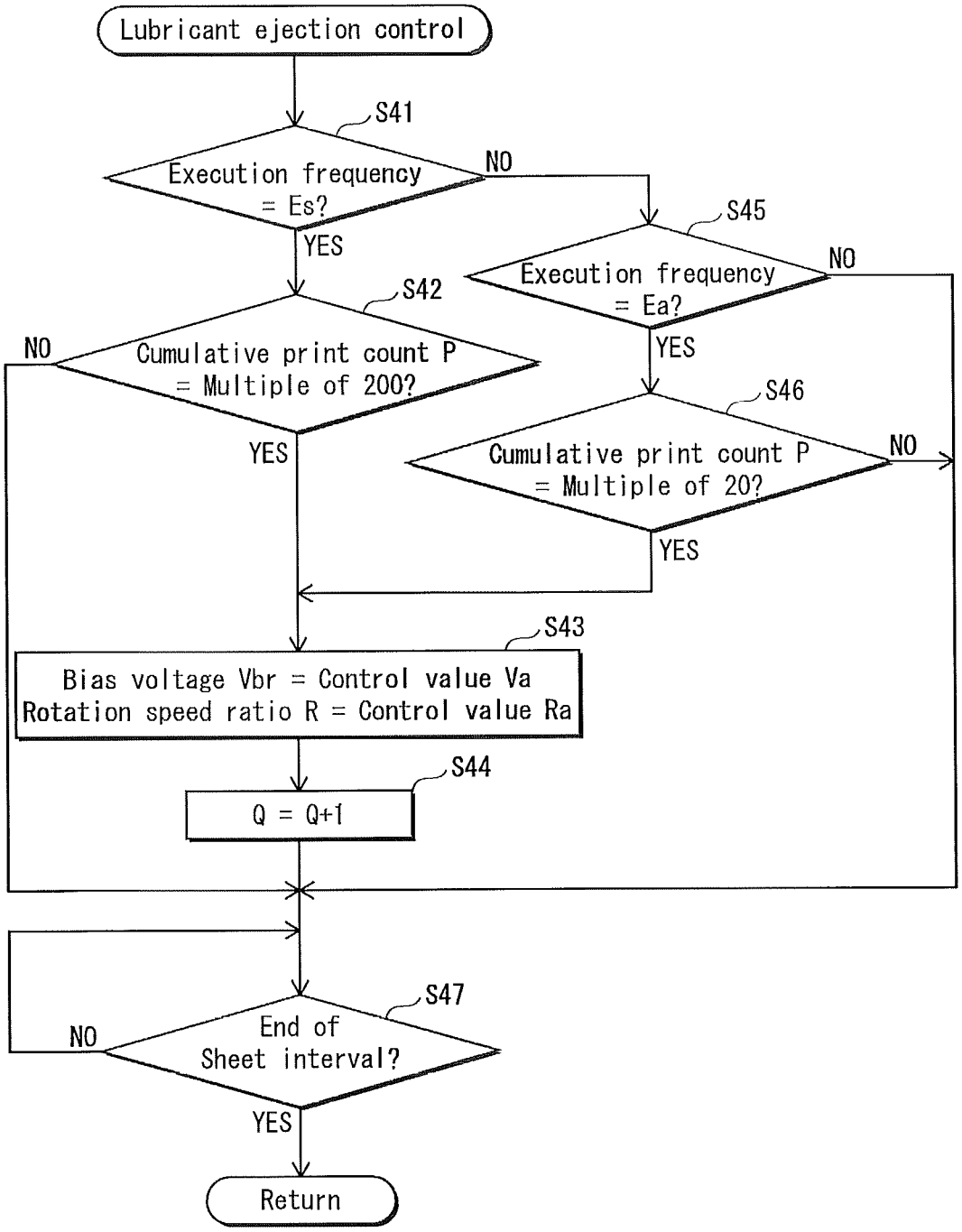
FIG. 11 is a flowchart showing a subroutine for lubricant ejection control.

FIGS. 9 through 11 are flowcharts showing the details of the lubricant supply control including the lubricant ejection control. This lubricant supply control is performed by the control unit 50 with respect to each of the image creating units 10Y through 10K during execution of each print job.

As shown in FIG. 9, first, the control unit 50 determines whether the current period is the sheet interval or not (Step S1).

This determination is made in the following manner. First, the control unit 50 obtains the timing at which the image formation begins and the timing at which the image formation completes during the execution of the print job for each of the image creating units 10Y through 10K. Then, the control unit 50 specifies the non-image formation period, which is between when the image formation on the $n^{th}$ sheet of the paper S completes and when the image formation on the $(n+1)^{th}$ sheet of the paper S begins among N sheets, N being the print count specified in the print job. Through these operations, the control unit 50 determines whether the current period is the image formation period or the non-image formation period (sheet interval) for each of the sheets to be printed by the execution of the print job.

When determining that the current period is not the sheet interval but is the image formation period ("NO" in Step S1), the control unit 50 sets the bias voltage Vbr to be the standard value Vs and the rotation speed ratio R to be the standard value Rs (Step S2). The control unit 50 next performs Step S3.

The values set to the bias voltage Vbr and the rotation speed ratio R are sent from the control unit 50 to the bias power supply unit 80 and the brush motor 105 (control instruction).

The bias power supply unit 80 outputs the bias voltage Vbr that is the same as the received value, and the brush motor 105 rotates the brush roller 101 at the rotation speed ratio R that is the same as the received value. In this meaning, the brush motor 105 serves as the speed changer for changing the rotation speed of the brush roller 101. The bias power supply unit 80 and the brush motor 105 are controlled every time the bias voltage Vbr and the rotation speed ratio R are set.

In Step S3, the control unit 50 determines whether the next sheet exists or not, that is, whether the image formation on the $N^{th}$ (i.e. the last) sheet of the paper S has completed or not. When it is determined that the next sheet does not exist ("NO" in Step S3), the control is terminated. If this is the case, the control unit 50 instructs the bias power supply unit 80 to stop outputting the bias voltage Vbr, and instructs the brush motor 105 to stop rotating the brush roller 101.

When it is determined that the next sheet exists ("YES" in Step S3), the processing returns to Step 1.

When the current period is not the sheet interval ("NO" in Step S1), the control unit 50 performs Step S2 and the subsequent steps. When the current period is the sheet interval ("YES" in Step S1), the control unit 50 performs the sheet interval processing (Step S4), and returns to Step S3.

FIG. 10 is a flowchart showing a subroutine for the sheet interval processing.

As shown in the drawing, the control unit 50 sequentially performs retained-lubricant amount estimation (Step S11), execution frequency setting (Step S12), and lubricant ejection control (Step S13).

The retained-lubricant amount estimating unit 58 stores therein an estimation table, which is used for estimating the accumulation amount Xa of the lubricant accumulated in the brush roller 101 (corresponding to the retained-lubricant amount Ga) in association with the total count of the prints measured since the beginning of the use of the brush roller 101. In the retained-lubricant amount estimation (Step S11), the retained-lubricant amount estimating unit 58 acquires the accumulation amount Xa according to the print count.

In the execution frequency setting (Step S12), the execution frequency setting unit 59 calculates the execution frequency from the accumulation amount Xa that the execution frequency setting unit 59 has obtained from the retained-lubricant amount estimation unit 58. This calculation may be performed by using a conversion table, and the conversion table may be stored in the execution frequency setting unit 59 in advance. Alternatively, a formula for the calculation may be used.

In this example, when the accumulation amount Xa is within the appropriate range (e.g. between 40 mg and 600 mg), the execution frequency E of the lubricant ejection operation is set to the standard value Es. When the accumulation amount Xa is above the appropriate range, the execution frequency of the lubricant ejection operation is set to Ea (>Es). When the accumulation amount Xa is below the appropriate range, the lubricant ejection operation is not performed.

FIG. 11 is a flowchart showing a subroutine for the lubricant ejection control (Step S13).

As shown in the drawing, the control unit 30 determines whether the execution frequency E has been set to the standard value Es or not (Step S41). When determining that the execution frequency E has been set to the standard value Es ("YES" in Step S41), the control unit 30 determines whether the current cumulative print count P is a multiple of 200 or not (Step S42). The value "200" represented as the print count indicates the execution frequency Es, and shows that the lubricant ejection control is performed during the non-image formation period (sheet interval) every time the printing has been performed on 200 sheets of paper S.

When determining that the current cumulative print count is a multiple of 200 (i.e, 200, 400, etc.) ("YES" in Step S42), the control unit 30 determines that the current non-image formation period (sheet interval) satisfies the condition for the lubricant ejection control, and sets the bias voltage Vbr to be the control value Va (<Vs) and sets the rotation speed ratio R to be the control value Ra(>Rs) (Step S43). As a consequence, the bias voltage Vbr and the rotation speed ratio R during the current non-image formation period (sheet interval) are respectively set to the control value Va and the control value Ra (Execution of the lubricant ejection operation).

After that, the control unit 30 updates the cumulative execution count Q by incrementing the cumulative execution count Q by 1 (Step S44), and moves to Step S47.

On the other hand, when determining that the current cumulative print count P is not a multiple of 200 ("NO" in Step S42), the control unit 30 skips Steps S43 and S44 (without executing them), and moves to Step S47. If this is the case, the control unit 30 determines that the current non-image formation period (sheet interval) does not satisfy the condition for the lubricant ejection control, and hence the bias voltage Vbr and the rotation speed ratio R are respectively kept at the standard values Vs and Rs as set in Step S2.

When determining that the execution frequency E is not the standard value Es ("NO" in Step S41), the control unit 30 determines whether the execution frequency E is Ea or not (Step S45).

When determining that the execution frequency E is Ea ("YES" in Step S45), the control unit 30 determines whether the current cumulative print count P is a multiple of 20 or not (Step S46). The value "20" represented as the print count indicates the execution frequency Ea, and shows that the lubricant ejection control is performed during the non-image formation period (sheet interval) every time the printing has been performed on 20 sheets of paper S. Compared to when the execution frequency is the standard value Es, the frequency of the lubricant ejection is 10 times greater, and the amount of the lubricant J to be ejected per unit number of rotations of the brush roller 101 increases accordingly.

When determining that the cumulative print count P is a multiple of 20 (i.e. 20, 40, etc.), the control unit 30 moves to Step S43. Thus, the lubricant ejection operation is performed during the current non-image formation period (sheet interval).

When determining that the current cumulative print count P is not a multiple of 20 ("NO" in Step S46), the control unit 30 skips Steps S43 and S44, and moves to Step S47. If this is the case, the bias voltage Vbr and the rotation speed ratio R are respectively kept at the standard values Vs and Rs as set in Step S2.

When determining that the execution frequency E is neither Es nor Ea (i.e. when determining that lubricant ejection operation is not to be performed) ("NO" in Step S45), the control unit 30 moves to Step S47.

In Step S47, the control unit 30 determines whether the period determined as the non-image formation period (sheet interval) terminates or not, and returns to the main routine when determining affirmatively ("YES" in Step S47).

(9) Advantageous Effects of Lubricant Ejection Control

FIG. 12 shows results of a durability test (regarding the condition of fogging and the performance in cleaning) conducted with apparatuses that perform the lubricant ejection control (Practical Examples 1 through 6) and apparatuses that do not perform the lubricant ejection control (Comparative Examples 1 through 3).

Apparatuses used in the test are Konica Minolta bizhub PRESS C8000 (capable of processing 80 sheets of A4 paper per minute) modified to have the structure shown in FIG. 2. Note that the solid lubricant 102 used in the test is made of zinc stearate.

The lubricant supply amount shown in FIG. 12 is represented in units of g/k sheets (grams per 1000 sheets). In each example, the potential difference ΔV between the brush roller 101 and the photosensitive drum during the image formation was adjusted such that the given amount of lubricant J as shown in the drawing would be supplied from the brush roller 101 to the photosensitive drum by the printing on 1000 sheets of paper S by each of the image creating units 10Y through 10K.

The brush pressure is the pressure generated by the compression spring 103. As shown in the drawing, the brush pressure of Comparative Example 1 is set at the same standard value as applied to the Practical Examples and the brush pressure of Comparative Example 3 is set lower than the standard value. The potential difference ΔV is the same. This is for the purpose of checking how the evaluation results change depending on the brush pressure when the potential difference ΔV is the same.

The values of ΔV, V0, Vbr, and R related to the lubricant ejection control are set for each example as shown in the drawing.

The micro vibration related to the lubricant ejection control is an operation for promoting the ejection of the lubricant J by superposing an alternating current bias voltage on the direct current bias voltage Vbr supplied to the brush roller 101. This operation is applied only in Practical Examples 4 through 6.

Figure 13:
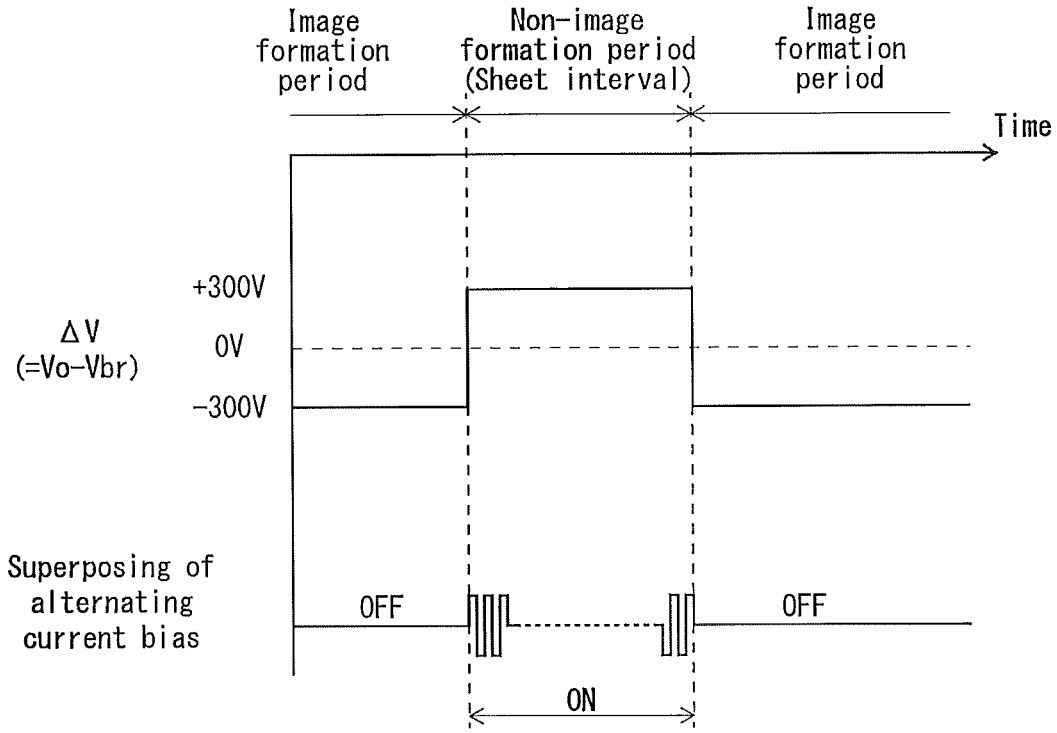
FIG. 13 shows a timing chart of control involving application of micro vibration.

FIG. 13 shows a timing chart of the control involving the micro vibration.

As shown in the drawing, during the image formation period, the potential difference ΔV between the drum surface potential Vo and the bias voltage Vbr is −300 V, and no alternating current bias is superposed onto the bias voltage Vbr (OFF).

During the non-image formation period (sheet interval), the potential difference ΔV is changed to +300 V, and the alternating current bias is superposed onto the bias voltage Vbr (ON).

This alternating current bias repeatedly generates an electric field for boosting, every half period of the alternating current, the electrostatic force acting on the negatively-charged lubricant J, held by the brush bristles 112, toward the photosensitive drum 1Y.

By determining the magnitude and the frequency of the alternating current bias voltage by tests or the like so that the lubricant J shows micro vibration under the condition of being held by the brush bristles 112, it is possible to allow the lubricant J to be readily released from the brush bristles 112 and to be readily ejected from the brush roller 101.

Returning to FIG. 12, the execution frequency E of the lubricant ejection operation is the frequency (Es, Ea or zero) as set in the above-described execution frequency setting shown in FIG. 10 (Step S12).

The cleaning blades 41Y through 41K are made of polyurethane rubber having a JIS-A hardness of 72 degrees and a rebound resilience of 25%. The contact force is 25 N/m, and the contact angle is 15°.

The conditions of the durability test were: the room temperature at 23° C.; and the humidity at 65% RH. Characters amounting to a coverage rate of 5% were printed on six sheets at a time. The printing was repeated until the cumulative rotation count of the photosensitive drum 1Y among the photosensitive drums 1Y through 1K reached 400 k.

In the durability test, the occurrence of fogging and a cleaning failure were evaluated. The fogging is an image noise caused by a decrease in the amount of charge on the toner contained in the developer, and such a decrease is caused by the lubricant J mixed into the Y, C, M and K color developers respectively housed in the developing units 3Y, 3C, 3M and 3K. The cleaning failure is an image noise caused by abrasion of the cleaning blades 41Y through 41K.

The evaluation of the performance in cleaning was conducted in the following manner after the durability test. A solid white image (amounting to coverage rate of 0%) was printed immediately after a solid black image (amounting to coverage rate of 100%) was printed under the room temperature at 10° C. and the humidity at 15% RH, and the occurrence of a cleaning failure in the solid white image was visually observed.

When no noise image having a line or belt-like shape could be visually observed, the performance in cleaning was evaluated as ○(good). When a barely visible noise image was found, the performance in cleaning was evaluated as Δ (acceptable). When a clearly visible noise image was found, the performance in cleaning was evaluated as x (failure).

The evaluation of fogging was conducted separately from the evaluation of the cleaning performance in the following manner. A solid white image was printed under the room temperature at 30° C. and the humidity at 85% RH, and the occurrence of a fogging in the solid white image was visually observed.

When no fogging could be visually observed, the performance was evaluated as ○ (good). When a barely visible noise image was found, the performance in was evaluated as Δ (acceptable). When a clearly visible noise image was found, the performance was evaluated as x (failure).

The retained-lubricant amount (mg) shown in the drawing is the total amount of the lubricant held by the brush roller 101 after the durability test. The mixed amount (wt %) is the proportion of the weight of the lubricant mixed into the developer relative to the weight of the developer. The friction coefficient is the friction coefficient of the cleaning blade 41Y after the durability test. Each value is an actual measurement value after the durability test. Note that the other cleaning blades 41M through 41K had a similar friction coefficient as the cleaning blade 41Y.

As seen from the evaluation results shown in the drawing, None of Practical Examples 1 through 6 has x (failure), which means that no fogging or cleaning failure occurred over the period from the early phase to the phase after the durability test, and the supply amount γ of the lubricant J to the photosensitive drums 1Y through 1K was stable over a long period.

In contrast, regarding Comparative Examples 1 and 2, the retained-lubricant amount is extremely greater than other examples, and the fogging is evaluated as failure.

This is thought to be due to the following reasons. In Comparative Examples 1 and 2, the lubricant ejection control is not performed, and too much lubricant J is accumulated in the brush bristles 112 over a long period. Therefore, the accumulation amount β becomes extremely small at the end of the durability test. Conversely, the supply amount γ to the photosensitive drums 1Y through 1K gradually increases. As a consequence, the amount of lubricant J mixed into the developer in the developing units 3Y through 3K from the photosensitive drums 1Y through 1K greatly increases compared to Practical Examples 1 through 6.

In Comparative Example 3, the cleaning failure was observed.

This is thought to be due to the following reasons. In Comparative Example 3, the amount of lubricant supply amount is much smaller than Comparative Examples 1 and 2. Therefore, the friction coefficient of the cleaning blade increases due to the lack of the lubricant J supplied to the photosensitive drums 1Y through 1K, and the increased abrasion of the cleaning blade caused the cleaning failure during the durability test.

No fogging occurred in Comparative Example 3, because even though the lubricant ejection control was not performed, the lubricant supply amount was much smaller than Comparative Examples 1 and 2, and therefore the retained-lubricant amount was as small as that of Practical Example 6, and accordingly the amount of the lubricant J mixed into the developer was small.

Although not shown in the above-described evaluation results, the performance in charging by the charging units 2Y through 2K were found stable over a long period.

As described above, according to the present embodiment, the ejection of the lubricant J from the brush roller 101 is controlled so that the amount of lubricant J retained by the brush roller 101 falls within the appropriate range F.

As a consequence, the present embodiment prevents the lubricant J from being excessively supplied from the brush roller 101 to the photosensitive drum 1Y over a long period due to too much accumulation of the lubricant J in the brush bristles 112, and thereby prevents that the excessive lubricant J supplied onto the photosensitive drum 1Y flies off during the rotation of the photosensitive drum 1Y and adheres to the charging wire 122 of the charging unit 2Y or is mixed into the developer housed in the developing unit 3Y. Accordingly, the present embodiment prevents the charging failure and the developing failure, and keeps preferable image quality.

Although the lubricant ejection control according to the description above is performed during the non-image formation period (sheet interval), this is not essential. For example, the lubricant ejection control may be performed during the image formation period or during both the image formation period and the non-image formation period. Furthermore, the lubricant ejection control is not necessarily performed during execution of a print job. For example, the lubricant ejection control may be performed after the non-image formation period after execution of a print job, with the photosensitive drum 1 and the brush roller 101 being rotated particularly for the purpose of the lubricant ejection.

The present invention is not limited to an image forming apparatus, and may be embodied as a lubricant application method involving lubricant ejection control. Also, the present invention may be a program that enables a computer to execute the method. A computer program pertaining to the present invention may be recorded on computer-readable recording media, including for example a magnetic tape, a magnetic disk such as a flexible disk, and an optical recording medium such as DVD-ROM, DVD-RAM, CD-ROM, CD-R, MO and PD. The computer program may be produced and transferred in the form of such a recording medium, or may be transmitted and provided via various kinds of wired or wireless networks such as the Internet or broadcasting, an electrical communication, satellite communication, or the likes.

<Modifications>

The present invention is described above based on the embodiment. However, the present invention is not limited to the embodiment as a matter of course. The following are possible modifications.

(1) The above-described embodiment is configured to, when performing the lubricant ejection control, change the bias voltage Vbr to Va that is lower than the standard value Vs and change the rotation speed ratio R to Ra that is greater than the standard value Rs. However, such a configuration is not essential.

For example, the embodiment may be configured to forcibly increase the drum surface potential Vo to Voc (≤0, e.g. −50 V) that is higher than a normal potential Voa (=−100V).

To increase the drum surface potential Vo to Voc, a charger (a charging unit) for each of the image creating units 10Y through 10K may be additionally provided within the space around the photosensitive drums 1Y through 1K, specifically the space extending from the positions (transfer points) between the photosensitive drum 1Y through 1K and the preliminary transfer rollers 26Y through 26K to the positions (cleaning points) of the cleaning blades 41Y through 41K along the drum rotation direction.

Figure 14:
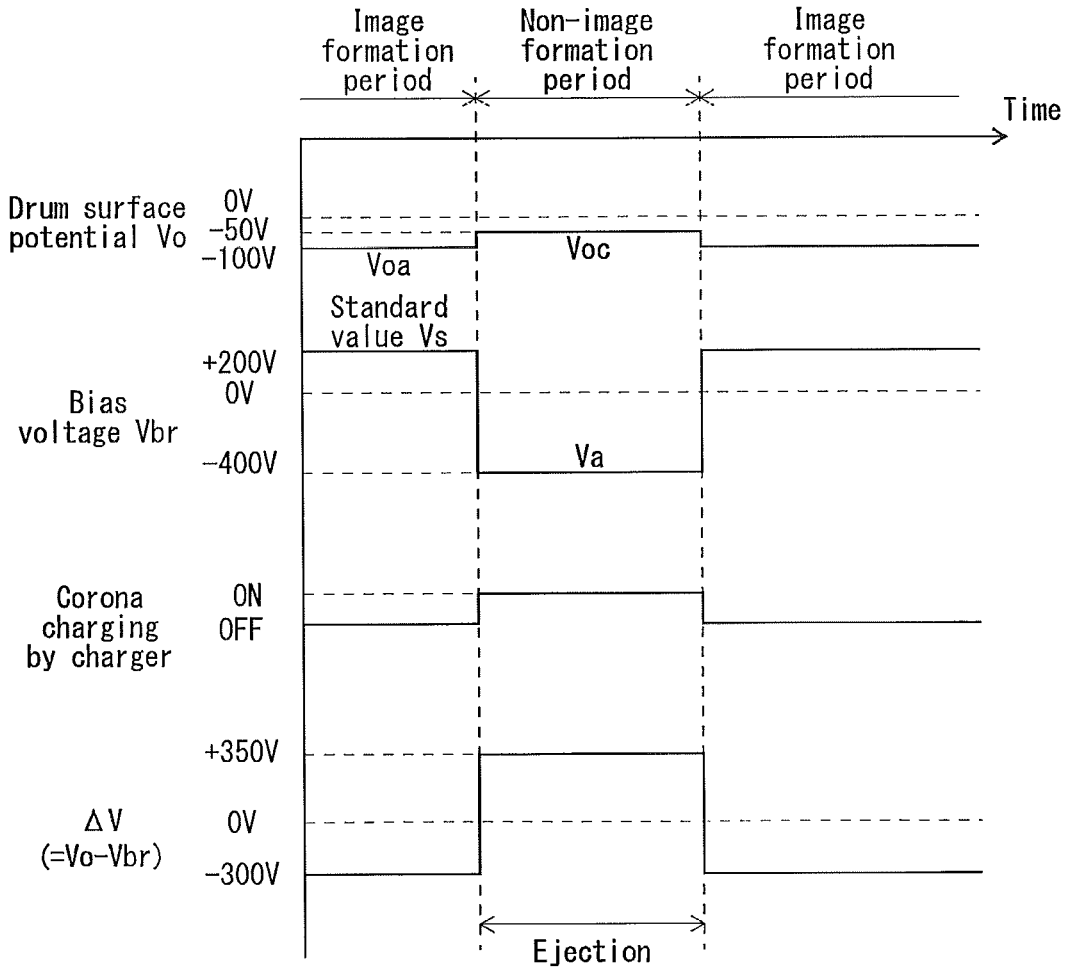
FIG. 14 shows an example timing chart of ejection control in the case where a charger pertaining to Modification is provided.

FIG. 14 shows an example timing chart of ejection control with a charger pertaining to the present modification. The present modification uses the additional chargers instead of switching the rotation speed ratio R, and therefore the rotation speed ratio R is not shown in the drawing.

As seen from the drawing, the corona charging by the charger is OFF during the image formation period, whereas during the non-image formation period (sheet interval), only while the lubricant ejection control is performed, charge current to the charger is controlled so as to switch the corona charging to ON.

As a consequence, the potential difference ΔV between the drum surface potential Vo and the bias voltage Vbr is increased to +350 V for example during the non-image formation period (sheet interval). Therefore, compared to the configuration without the charger as shown in FIG. 4 (ΔV=+300), the configuration with the charger increases the amount of the lubricant to be ejected, because of the increase in the drum surface potential Vo. Since the photosensitive drums 1Y through 1K are to be negatively charged, the potential of the corona charge is determined such that the drum surface potential Vob after the charging will be no greater than 0 and the potential of the corona charge will be smaller in absolute value than the drum surface potential Voa (=−100 V) during the image formation period (in which the lubricant ejection operation is not performed).

The position of the charger is not limited to the above-described position. For example the charger may be located at any point within the area extending from the transfer point on the photosensitive drum to the lubricant application point 106 along the drum rotational direction according to the size of the space within the apparatus. Furthermore, if the lubricant ejection operation can be realized by the charger only, a configuration that does not change the bias voltage Vbr may be used.

(2) According to the above-described embodiment, the accumulation amount Xa is obtained by using the cumulative print count P which indicates the history of the operations of the brush roller 101. However, this is not essential.

For example, a cumulative rotation count Pz of the brush roller 101 up to the current time may be used as the operation history. Specifically, an estimation table that associates the accumulation amount Xa accumulated in the brush roller 101 with the cumulative rotation count Pz from the beginning of the use of the brush roller 101 may be stored, and the accumulation amount Xa may be obtained with reference to this table.

The accumulation amount Xa may be obtained by, instead of by using the estimation table, obtaining in advance an accumulation amount β2 (mg/rotation) for example by experiments or the like, which indicates the amount of lubricant J accumulated in the brush roller 101 per rotation of the brush roller 101, and obtaining the cumulative rotation count Pz of the brush roller 101 by using a rotation count detection unit realized with a rotation counter (not depicted in the drawings). Specifically, the accumulation amount Xa can be obtained by multiplying the cumulative rotation count Pz by the accumulation amount β2 (mg/rotation).

Alternatively, a cumulative rotation time Tz up to the current time of the brush roller 101 may be used as the operation history. If this is the case, the accumulation amount Xa may be obtained by obtaining in advance, by experiments or the like, an accumulation amount (mg/time) of the lubricant J to be accumulated in the brush roller 101 due to the rotation of the brush roller 101 during a unit time period, and counting the cumulative rotation time Tz of the brush roller 101 by using a timer (not depicted in the drawing). Specifically, the accumulation amount Xa can be obtained by multiplying the cumulative rotation time Tz by the accumulation amount (mg/time).

Alternatively, a cumulative rotation count Py of the photosensitive drum 1Y up to the current time may be used as the operation history. If this is the case, the accumulation amount Xa may be obtained by obtaining in advance, by experiments or the like, an accumulation amount (mg/rotation) of the lubricant J to be accumulated in the brush roller 101 that rotates simultaneously with the photosensitive drum 1Y, per rotation of the photosensitive drum 1Y, and obtaining a cumulative rotation count Py of the photosensitive drum 1Y by using a rotation count detection unit. Specifically, the accumulation amount Xa can be obtained by multiplying the cumulative rotation count Py by the accumulation amount (mg/rotation).

Alternatively, a cumulative rotation time Ty of the photosensitive drum 1Y up to the current time may be used as the operation history. If this is the case, the accumulation amount Xa may be obtained by obtaining in advance, by experiments or the like, an accumulation amount (mg/time) of the lubricant J to be accumulated in the brush roller 101 due to the rotation of the photosensitive drum 1Y during a unit time period, and obtaining a cumulative rotation time Ty of the photosensitive drum 1Y by using a timer. Specifically, the accumulation amount Xa can be obtained by multiplying the cumulative rotation time Ty by the accumulation amount (mg/time).

(3) According to the above-described embodiment, the accumulation amount Xa is obtained based on the assumption that the drum surface potential Vo after the cleaning is substantially constant at −100 V. However, if the photosensitive drums 1Y through 1K have characteristics with which the drum surface potential Vo is likely to vary, the following configuration may be adopted.

That is, a potential detector such as a potential sensor may be used to detect the drum surface potential Vo, and the accumulation amount Xa may be corrected based on the drum surface potential Vo thus detected.

Specifically, when the standard value of the drum surface potential Vo is −100 V and the detected drum surface potential Vd is lower than the standard value (Vd<−100 V), the lubricant J is more likely to be accumulated in the brush roller 101 compared to when the drum surface potential Vd is at the standard value, and the supply amount γ of the lubricant J supplied to the photosensitive drum 1Y is smaller than in the case of the standard value. Accordingly, the accumulation amount Xa will be larger than in the case of the standard value.

Therefore, the variability of the drum surface potential Vo can be taken into consideration by obtaining a corrected accumulation amount by adding the amount corresponding to the difference from the case of the standard value to the accumulation amount Xa based on the conditions corresponding to the standard value.

Conversely, when the detected drum surface potential Vd is higher than the standard value (Vd>−100 V), the lubricant J is less likely to be accumulated in the brush roller 101 compared to when the drum surface potential Vd is at the standard value, and the supply amount γ of the lubricant J supplied to the photosensitive drum 1Y is greater than in the case of the standard value. Accordingly, the accumulation amount Xa will be smaller than in the case of the standard value.

Therefore, the variability of the drum surface potential Vo can be taken into consideration by obtaining a corrected accumulation amount by subtracting the amount corresponding to the difference from the case of the standard value from the accumulation amount Xa based on the conditions corresponding to the standard value.

The appropriate relationship between the degree of the change in the drum surface potential Vo and the correction value to be applied to the accumulation amount Xa may be obtained in advance by experiments or the like. The accumulation amount Xa corresponding to the variability of the drum surface potential Vo can be obtained by using a table or a mathematical formula showing the relationship.

Note that when the bias voltage Vbr applied to the brush roller 101 is constant, the detection of the drum surface potential Vo is substantially equivalent to the detection of ΔV (=Vo−Vbr), which is the potential difference between the brush roller 101 and the circumferential surface of the photosensitive drum 1Y.

In addition to the drum surface potential Vo, the potential of the brush roller 101 may also be taken into consideration. Specifically, a voltmeter detecting the voltage applied to the brush roller 101 may be additionally provided, and the above-described correction may be performed based on the difference ΔV between the detected voltage value and the drum surface potential Vo.

(4) In the embodiment above, an example structure for ejecting the lubricant J retained by the brush roller 101 by generating an electric field between the photosensitive drum 1Y and the brush roller 101 is described, which serves as an ejector. However, this is not essential.

Figure 15:
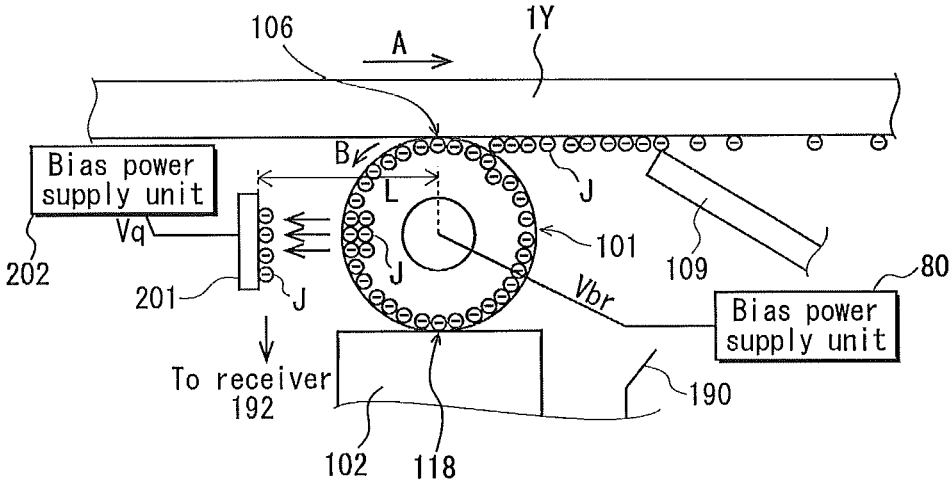
FIG. 15 is a schematic diagram showing a structure with an electrode pertaining to Modification.

For example, as shown in FIG. 15, an electrode 201 may be disposed within the housing 190. Specifically, the electrode 201 may be located near the brush roller 101 and within the space extending along the rotational direction of the brush roller 101 from the lubricant application point 106 to a lubricant pickup position 118 where the brush roller 101 picks up the lubricant.

The electrode 201 has an elongated shape extending along the axis direction of the brush roller 101 and is made of an electrically conductive material such as metal. The bias power supply unit 202 applies a bias voltage Vq to the electrode 201.

When the radius R of the brush roller 101 is 6 mm for example, and L denotes the distance between the center point of the brush roller 101 and the electrode 201, $-0.5 \leq (L-R) \leq +1.0$, and preferably $(L-R)=0$.

When the electrode 201 is used, the following control can be performed.

Assume that the potential difference between the brush roller 101 and the electrode 201 is $\Delta Vq$ ($=Vq-Vbr$). When the condition for performing the lubricant ejection control is satisfied, the bias voltage Vq set higher than the standard value Vs, for example Vq=+400 V, is applied to the electrode 201 such that the potential difference $\Delta Vq$ will be greater than 0, with the bias voltage Vbr maintained at the standard value Vs used in the image formation period (+200 V in the above-described example).

Due to the electric field caused by the potential difference between the brush roller 101 and the electrode 201, a force (electrostatic force) acting in the direction from the brush roller 101 to the electrode 201 is generated between the brush roller 101 and the electrode 201, which affects the negatively-charged lubricant J accumulated in the roller 101.

Accordingly, the lubricant J accumulated in the brush roller 101 flies off the brush roller 101 directly to the electrode 201 and adheres to the electrode 201, and thus the brush roller 101 ejects the lubricant J.

After the lubricant ejection operation completes, the potential difference $\Delta Vq$ is set at 0 by, for example, changing the bias voltage Vq applied to the electrode 201 to be the same as the bias voltage Vbr, or by setting both the bias voltage Vq and the bias voltage Vbr to be 0 V. As a consequence, the electrostatic force stops acting on the lubricant J, and the lubricant J adhering to the electrode 201 falls off the electrode 201 by its own weight.

In this modification example, a receiver 192 is provided right below the electrode 201, and the lubricant J falling off the electrode 201 is received by the receiver 192 provided within the housing 190 and serving as a collector.

On the other hand, when the condition for performing the lubricant ejection control is not satisfied, $\Delta Vq$ is set to be no greater than 0, with the bias voltage Vbr maintained at the standard value Vs. For example, a bias voltage Vq having the negative polarity as with the lubricant J is applied to the electrode 201. As a consequence, the electric field acts to prevent the lubricant J from moving from the brush roller 101 to the electrode 201.

When the electrode 201 is provided, it is unnecessary, unlike the above-described embodiment, to use the flattening blade 104 to scrape off the lubricant J ejected from the brush roller 101 onto the photosensitive drum at once. If it is possible to form the film of the lubricant J without the use of the flattening blade 104, it is possible to omit the flattening blade 104.

Furthermore, since it is unnecessary to keep rotating the photosensitive drum, it is possible to stop the rotation of the photosensitive drum and rotate the brush roller 101 only. The rotation of the brush roller 101 may also be stopped if the lubricant ejection can be performed.

The bias voltage Vq applied to the electrode 201 during the lubricant ejection control may be a direct current voltage having an opposite polarity as the lubricant J, namely the positive polarity. Alternatively, an alternating current voltage may be superposed on the direct current voltage. The magnitude, the type (direct current or alternating current), the frequency, and so on of the voltage appropriate for the lubricant ejection operation are determined in advance by experiments or the like.

In the description above, the bias voltage Vbr is maintained at the standard value Vs used in the image formation period, regardless of whether the condition for performing the lubricant ejection control is satisfied or not. However, this is not essential.

When the condition for performing the lubricant ejection control is satisfied, the bias voltage Vbr may be changed within the range satisfying the potential difference $\Delta V<0$ in order to realize more appropriate lubricant ejection operation from the brush roller 101 to the electrode 201. For example, the bias voltage Vbr may be set lower than the stand value Vs, or be changed to a voltage generated by superposing an alternating current voltage onto a direct current voltage.

In addition, the location of the electrode 201 is not limited to the example shown in FIG. 15. For example, the electrode 201 may be located at a position near the brush roller 101 and within the space extending along the rotational direction of the brush roller 101 from the lubricant pickup position 118 to the lubricant application point 106.

The electrode 201 does not necessarily have a plate-like shape, and may have a rod-like shape. The lubricant ejection operation pertaining to the embodiment, which is performed for ejecting the lubricant J to the photosensitive drum, and the lubricant ejection operation pertaining to the present modification example, which is performed for ejecting the lubricant J to the electrode 201, may be performed simultaneously.

Furthermore, as an additional ejector different from the above-described ejector, it is possible to adopt a structure for sucking the lubricant J accumulated in the brush roller 101 within the housing 190 by using air.

If such a structure is adopted, the suction end of the duct for sucking the air may be located near the brush roller 101, and the sucking may be performed when the condition for performing the lubricant ejection control is satisfied. If this is the case, the lubricant J ejected from the brush roller 101 can be collected by guiding the sucked lubricant J to the receiver 192 via the duct. Even in this case, it is acceptable that the brush roller 101 is rotated or the rotation of the brush roller 101 is stopped.

(5) In the above-described embodiment, the solid lubricant 102 is used as the source of the lubricant. However, this is not essential. For example, a lubricant powder housed within a casing may be used as the lubricant source, and a portion of the lubricant powder may be picked up by the brush roller 101 and be supplied to the photosensitive drum.

Also, although the brush roller 101 is used as a rotative transporter for holding the lubricant J picked up from the lubricant source and feeding the lubricant J to the application point 106 at which the lubricant J is applied to the photosensitive drums 1Y through 1K serving as image carriers, the rotative transporter is not necessarily a brush. For example, a roller wrapped with nonwoven fabric, a sponge-like feeder, or a roller having small concavities and convexities on its circumferential surface may be used.

(6) In the above-described embodiment, the lubricant ejection control for forcibly ejecting the lubricant J from the brush roller 101 is performed. In addition, lubricant accumulation control for forcibly accumulating the lubricant J in the brush roller 101 may be performed during the period in which no much lubricant J is accumulated in the brush roller 101, for example when the brush roller 101 is brand-new.

The lubricant accumulation control is performed during, for example, a period in which no print job is executed, by stopping the rotation of the photosensitive drum and keeping rotating the brush roller 101 under the condition where the potential difference ΔV is smaller than 0. The lubricant J scraped from the solid lubricant 102 by the brush roller 101 is accumulated in the brush bristles 112 of the brush roller 101 without being supplied to the photosensitive drum.

If the lubricant accumulation control is performed immediately after the beginning of the use of the brush roller 101 which is brand-new, the retained-lubricant amount Ga as shown in FIG. 8 falls within the appropriate range F at an earlier phase, and the retaining capability Gb becomes stable at an earlier phase. As a consequence, the amount of the lubricant J supplied to the photosensitive drum becomes stable at an earlier phase.

(7) The above-described embodiment is an example in which the image forming apparatus pertaining to the present invention is adopted in a tandem color printer. However, the present invention is not limited to this. The image forming apparatus pertaining to the present invention may be adopted in, for example, copiers, fax machines and MFPs (Multiple Function Peripherals), regardless of whether it is a color apparatus or a monochrome apparatus if they have a structure for applying lubricant to the circumferential surface of the rotative image carriers.

In the above-described embodiment, the cleaning blades 41Y through 41K are used as cleaners that are in contact with the photosensitive drums 1Y through 1K and remove a residual material such as toner on the photosensitive drums 1Y through 1K after the primary transfer. However, the cleaners do not necessarily have a blade-like shape, and may have another shape. If this is the case, there is a possibility that no problem will be caused by the increase in the friction between the cleaning blades 41Y through 41K and the circumferential surfaces of the photosensitive drum 1Y through 1K. Even in this case, however, the stated structure achieves an advantageous effect that the supply of the lubricant becomes stable and improves the quality of the image transfer over a long period.

Furthermore, although the flattening blade 104 is used for each of the photosensitive drums 1Y through 1K to flatten the lubricant J supplied onto the photosensitive drum, the flattener does not necessarily have a blade-like shape. The flattener may have any shape insofar as it has the function of flattening and scraping off, from the photosensitive drum, the lubricant J ejected at once onto the photosensitive drum by the lubricant ejection control. For example, a roller-like member that is in contact with the photosensitive drum may be used as the flattener.

In the above-described embodiment, the photosensitive drums are used as the image carriers. However, it is not essential that the image carriers have a drum-like shape, and they may have a belt-like shape, for example.

The photosensitive drums 1Y through 1K are used as the image carriers, and the intermediate transfer belt 21 is used as the object to which the images on the photosensitive drums are transferred. However, this is not essential.

For example, an intermediate transferrer like the intermediate transfer belt 21 may be regarded as the image carrier, and the recording sheet onto which the images on the intermediate transfer belt 21 are transferred may be regarded as the object. The lubricant may be applied to the intermediate transferrer, and a residual material such as toner on the intermediate transferrer may be removed by a cleaner such as the cleaning blade. The stated structure prevents the lubricant, when supplied excessively to the intermediate transferrer, from being transferred to the developing unit and so on via the photosensitive drums that is in contact with the intermediate transferrer.

When the image forming apparatus is not provide with the intermediate transferrer, the photosensitive drums may be regarded as the image carriers and the recording sheet may be regarded as the object onto which the images on the photosensitive drums are to be transferred.

The material, the size, the shape, the voltage, the speed, the rotational direction, the electrical resistivity and so on of the above-described components, and the print count, the retaining amount and so on are not limited to those indicated by the above-described numeric values, and may be determined according to the structure of the apparatus.

The present invention may be any combinations of the above-described embodiment and modifications.

SUMMARY

The above-described embodiment and modifications show aspects of the present invention solving the problems described in the RELATED ART section. The embodiment and the modifications can be summarized as follows.

One aspect of the present invention is an image forming apparatus for forming an image on a rotative image carrier and transferring the image onto an object, comprising: a cleaning unit that removes a residual material from the rotative image carrier after the image has been transferred onto the object; and a lubricant applying unit that applies lubricant to a circumferential surface of the rotative image carrier after the residual material has been removed, the lubricant applying unit including: a rotative transporter that picks up and retains lubricant from a lubricant source, transports the lubricant to a lubricant application point, and supplies a portion of the lubricant to the rotative image carrier at the lubricant application point; an ejector that causes the rotative transporter to eject a portion of the lubricant retained by the rotative transporter; a collector that collects the portion of the lubricant ejected from the rotative transporter; and a controller that controls ejection of the portion of the lubricant caused by the ejector so as to maintain the amount of the lubricant retained by the rotative transporter as no greater than a predetermined upper limit.

The ejector may cause the rotative transporter to eject the portion of the lubricant onto the rotative image carrier, and the collector may includes a flattener that faces the rotative image carrier and flattens the portion of the lubricant on the rotative image carrier by allowing the portion of the lubricant to pass through a gap between the flattener and the rotative image carrier; and a receiver that is located below a point at which the flattener faces the rotative image carrier, and receives a portion of the lubricant failing to pass through the gap and falling off the rotative image carrier.

The controller may include an estimator that estimates the amount of lubricant being retained by the rotative transporter at a current time point according to an operation history of the rotative transporter.

The estimator may obtain, according to the operation history of the rotative transporter, an accumulation amount of lubricant remaining on the rotative transporter at the current time point without having been supplied to the rotative image carrier, and may estimate the amount of the lubricant being retained by the rotative transporter at the current time point to be equal to the accumulation amount.

The lubricant may be made of electrically chargeable material, the ejector may include an electric field generator that generates an electric field between the rotative transporter and the rotative image carrier, the electric field acting on the lubricant that has been charged so as to move the lubricant from the rotative transporter to the rotative image carrier, the controller, when controlling the ejection of the portion of the lubricant, may control the electric field generator to generate the electric field between the rotative transporter and the rotative image carrier, and the estimator may include a detector that detects potential difference between surface potential of the rotative image carrier and a potential of the rotative transporter, and correct the accumulation amount based on the potential difference.

The controller may control the ejection during a period other than an image formation period, the image formation period being a period during which the image is formed on the rotative image carrier.

The controller may control the ejection such that the amount of the portion of the lubricant ejected from the rotative transporter per a predetermined number of rotations of the rotative transporter equals a first amount when the amount of the lubricant being retained by the rotative transporter is no greater than the predetermined upper limit, and may control the ejection such that the amount of the portion of the lubricant ejected from the rotative transporter per a predetermined number of rotations of the rotative transporter equals a second amount greater than the first amount when the amount of the lubricant being retained by the rotative transporter is greater than the predetermined upper limit.

The lubricant may be made of electrically chargeable material, the ejector may include an electric field generator that generates an electric field between the rotative transporter and the rotative image carrier, the electric field acting on the lubricant that has been charged so as to move the lubricant from the rotative transporter to the rotative image carrier, and the controller, when controlling the ejection of the portion of the lubricant, may control the electric field generator to generate the electric field between the rotative transporter and the rotative image carrier.

The electric field generator may be at least one of a power supplier applying bias voltage to the rotative transporter to generate the electric field and a charger that charges the rotative image carrier.

The bias voltage may be a direct current voltage having a same polarity as a charge polarity of the lubricant, or a voltage generated by superposing an alternating current voltage thereon.

The charger may be located near the rotative image carrier and within an area extending from a transfer point on the rotative image carrier to the lubricant application point on the rotative image carrier along a rotational direction of the rotative image carrier.

The ejector may further include a speed changer that changes a rotation speed of the rotative transporter, and the controller, when the ejection of the portion of the lubricant is to be performed, may control the speed changer to change the rotation speed of the rotative transporter to be higher than when the ejection is not performed.

The lubricant may be made of electrically chargeable material, the ejector may include: an electrode; and an electric field generator that generates an electric field between the rotative transporter and the electrode, the electric field acting on the lubricant that has been charged so as to move the lubricant from the rotative transporter to the electrode, and the collector may include a receiver that receives a portion of the lubricant ejected from the rotative transporter toward the electrode.

The lubricant source may be solid lubricant, and the rotative transporter may be a brush roller receiving the lubricant by scraping a surface of the solid lubricant.

Another aspect of the present invention is a lubricant application method used by an image forming apparatus that transfers an image formed on a rotative image carrier onto an object, removes a residual material on the rotative image carrier by using a cleaning unit after the image has been transferred onto the object, and applies lubricant to a circumferential surface of the rotative image carrier by using a lubricant applying unit after the residual material has been removed, the lubricant application method comprising: a first step of picking up and retaining lubricant from a lubricant source by using a rotative transporter included in the lubricant applying unit, transporting the lubricant to a lubricant application point, and supplying a portion of the lubricant to the rotative image carrier at the lubricant application point; a second step of controlling ejection of the portion of the lubricant caused by an ejector so as to maintain the amount of the lubricant retained by the rotative transporter to be no greater than a predetermined upper limit; and a third step of collecting the portion of the lubricant ejected from the rotative transporter by using a collector included in the lubricant applying unit.

The stated structures prevent the lubricant from being excessively accumulated in the rotative transporter over a long period. Therefore, the stated structures maintain the appropriate balance between the amount of the lubricant supplied from the rotative transporter to the image carrier and the amount of the lubricant accumulated in the rotative transporter without being supplied to the image carrier, over a long period, and allow for stable supply of the lubricant to the image carrier and prevent, for example, the occurrence of a developing failure caused by excessive supply of lubricant to the image carrier.

The lubricant ejected from the rotative transporter is collected in the collector provided at the lubricant applying unit. Therefore, the lubricant is prevented from being mixed into the developer housed in the developing unit for example and causing a developing failure.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus for forming an image on a rotative image carrier and transferring the image onto an object, comprising:

a cleaning unit that removes a residual material from the rotative image carrier after the image has been transferred onto the object; and a lubricant applying unit that applies lubricant to a circumferential surface of the rotative image carrier after the residual material has been removed, the lubricant applying unit including:

a rotative transporter that picks up and retains lubricant from a lubricant source, transports the lubricant to a lubricant application point, and supplies a portion of the lubricant to the rotative image carrier at the lubricant application point;

an ejector that causes the rotative transporter to eject a portion of the lubricant retained by the rotative transporter;

a collector that collects the portion of the lubricant ejected from the rotative transporter; and a controller that controls ejection of the portion of the lubricant caused by the ejector so as to maintain the amount of the lubricant retained by the rotative transporter as no greater than a predetermined upper limit, wherein the controller controls the ejection such that the amount of the portion of the lubricant ejected from the rotative transporter per a predetermined number of rotations of the rotative transporter equals a first amount when the amount of the lubricant being retained by the rotative transporter is no greater than the predetermined upper limit, and controls the ejection such that the amount of the portion of the lubricant ejected from the rotative transporter per a predetermined number of rotations of the rotative transporter equals a second amount greater than the first amount when the amount of the lubricant being retained by the rotative transporter is greater than the predetermined upper limit.

2. The image forming apparatus of claim 1, wherein the ejector causes the rotative transporter to eject the portion of the lubricant onto the rotative image carrier, and the collector includes:

a flattener that faces the rotative image carrier and flattens the portion of the lubricant on the rotative image carrier by allowing the portion of the lubricant to pass through a gap between the flattener and the rotative image carrier; and a receiver that is located below a point at which the flattener faces the rotative image carrier, and receives a portion of the lubricant failing to pass through the gap and falling off the rotative image carrier.

3. The image forming apparatus of claim 1, wherein the controller includes an estimator that estimates the amount of lubricant being retained by the rotative transporter at a current time point according to an operation history of the rotative transporter.

4. The image forming apparatus of claim 3, wherein the estimator obtains, according to the operation history of the rotative transporter, an accumulation amount of lubricant remaining on the rotative transporter at the current time point without having been supplied to the rotative image carrier, and estimates the amount of the lubricant being retained by the rotative transporter at the current time point to be equal to the accumulation amount.

5. The image forming apparatus of claim 4, wherein the lubricant is made of electrically chargeable material, the ejector includes an electric field generator that generates an electric field between the rotative transporter and the rotative image carrier, the electric field acting on the lubricant that has been charged so as to move the lubricant from the rotative transporter to the rotative image carrier, the controller, when controlling the ejection of the portion of the lubricant, controls the electric field generator to generate the electric field between the rotative transporter and the rotative image carrier, and the estimator includes a detector that detects potential difference between surface potential of the rotative image carrier and a potential of the rotative transporter, and corrects the accumulation amount based on the potential difference.

6. The image forming apparatus of claim 1, wherein the controller controls the ejection during a period other than an image formation period, the image formation period being a period during which the image is formed on the rotative image carrier.

7. The image forming apparatus of claim 1, wherein the lubricant is made of electrically chargeable material, the ejector includes an electric field generator that generates an electric field between the rotative transporter and the rotative image carrier, the electric field acting on the lubricant that has been charged so as to move the lubricant from the rotative transporter to the rotative image carrier, and the controller, when controlling the ejection of the portion of the lubricant, controls the electric field generator to generate the electric field between the rotative transporter and the rotative image carrier.

8. The image forming apparatus of claim 7, wherein the electric field generator is at least one of a power supplier applying bias voltage to the rotative transporter to generate the electric field and a charger that charges the rotative image carrier.

9. The image forming apparatus of claim 8, wherein the bias voltage is a direct current voltage having a same polarity as a charge polarity of the lubricant, or a voltage generated by superposing an alternating current voltage thereon.

10. The image forming apparatus of claim 8, wherein the charger is located near the rotative image carrier and within an area extending from a transfer point on the rotative image carrier to the lubricant application point on the rotative image carrier along a rotational direction of the rotative image carrier.

11. The image forming apparatus of claim 7, wherein the ejector further includes a speed changer that changes a rotation speed of the rotative transporter, and the controller, when the ejection of the portion of the lubricant is to be performed, controls the speed changer to change the rotation speed of the rotative transporter to be higher than when the ejection is not performed.

12. The image forming apparatus of claim 1, wherein the lubricant is made of electrically chargeable material, the ejector includes:

an electrode; and an electric field generator that generates an electric field between the rotative transporter and the electrode, the electric field acting on the lubricant that has been charged so as to move the lubricant from the rotative transporter to the electrode, and the collector includes a receiver that receives a portion of the lubricant ejected from the rotative transporter toward the electrode.

13. The image forming apparatus of claim 1, wherein the lubricant source is solid lubricant, and the rotative transporter is a brush roller receiving the lubricant by scraping a surface of the solid lubricant.

14. A lubricant application method used by an image forming apparatus that transfers an image formed on a rotative image carrier onto an object, removes a residual material on the rotative image carrier by using a cleaning unit after the image has been transferred onto the object, and applies lubricant to a circumferential surface of the rotative image carrier by using a lubricant applying unit after the residual material has been removed, the lubricant application method comprising:

a first step of picking up and retaining lubricant from a lubricant source by using a rotative transporter included in the lubricant applying unit, transporting the lubricant to a lubricant application point, and supplying a portion of the lubricant to the rotative image carrier at the lubricant application point;

a second step of controlling ejection of the portion of the lubricant caused by an ejector so as to maintain an amount of the lubricant retained by the rotative transporter to be no greater than a predetermined upper limit, and controlling the ejection such that the amount of the portion of the lubricant ejected from the rotative transporter per a predetermined number of rotations of the rotative transporter equals a first amount when the amount of the lubricant being retained by the rotative transporter is no greater than the predetermined upper limit, and controls the ejection such that the amount of the portion of the lubricant ejected from the rotative transporter per a predetermined number of rotations of the rotative transporter equals a second amount greater than the first amount when the amount of the lubricant being retained by the rotative transporter is greater than the predetermined upper limit; and a third step of collecting the portion of the lubricant ejected from the rotative transporter by using a collector included in the lubricant applying unit.

15. The method of claim 14, comprising:

estimating the amount of lubricant being retained by the rotative transporter at a current time point according to an operation history of the rotative transporter.

16. The method of claim 14, comprising:

controlling the ejection during a period other than an image formation period, the image formation period being a period during which the image is formed on the rotative image carrier.

17. The method of claim 14, wherein the lubricant is made of electrically chargeable material, and generating an electric field between the rotative transporter and the rotative image carrier with an electric field generator, the electric field acting on the lubricant that has been charged so as to move the lubricant from the rotative transporter to the rotative image carrier, and when controlling the ejection of the portion of the lubricant, controlling the electric field generator to generate the electric field between the rotative transporter and the rotative image carrier.

18. The method of claim 14, wherein the lubricant is made of electrically chargeable material, the ejector includes:

an electrode; and generating an electric field between the rotative transporter and the electrode with an electric field generator, the electric field acting on the lubricant that has been charged so as to move the lubricant from the rotative transporter to the electrode, and the collector includes a receiver that receives a portion of the lubricant ejected from the rotative transporter toward the electrode.

* * * * *